US008807566B2

(12) United States Patent
Zagyvai

(10) Patent No.: US 8,807,566 B2
(45) Date of Patent: Aug. 19, 2014

(54) SPATIAL LOGICAL AND SKILL IMPROVEMENT GAME, PARTICULARLY A LABYRINTH GAME

(75) Inventor: András Zagyvai, Budapest (HU)

(73) Assignee: Art & Smart Egg Kft., Budapest (HU)

( * ) Notice: Subject to any disclaimer, the term of this patent is extended or adjusted under 35 U.S.C. 154(b) by 0 days.

(21) Appl. No.: 13/696,075

(22) PCT Filed: May 5, 2010

(86) PCT No.: PCT/HU2010/000051

§ 371 (c)(1),
(2), (4) Date: Nov. 20, 2012

(87) PCT Pub. No.: WO2011/138623

PCT Pub. Date: Nov. 10, 2011

(65) Prior Publication Data

US 2013/0134675 A1 May 30, 2013

(51) Int. Cl.

| | |
|---|---|
| ***A63F 9/08*** | (2006.01) |
| ***A63F 9/00*** | (2006.01) |
| ***A63H 33/00*** | (2006.01) |
| *A63F 9/12* | (2006.01) |

(52) U.S. Cl.

CPC ..... *A63H 33/00* (2013.01); *A63F 9/0078* (2013.01); *A63F 9/1252* (2013.01); *A63F 9/0876* (2013.01)

USPC ..... 273/156; 273/153 S; 273/153 R

(58) Field of Classification Search

CPC ..... A63F 9/08; A63F 9/0826; A63F 9/0857; A63F 2009/08; A63F 2009/0826; A63F 9/0078; A63F 9/1252

USPC ..... 273/153 R, 156, 157 R, 160, 153 S

See application file for complete search history.

(56) References Cited

U.S. PATENT DOCUMENTS

| | | | | | |
|---|---|---|---|---|---|
| 598,889 | A | | 2/1898 | Young | |
| 2,714,511 | A | * | 8/1955 | Derrig | 273/153 R |
| 3,612,537 | A | * | 10/1971 | Sato | 273/156 |
| 3,819,187 | A | * | 6/1974 | Downs | 273/156 |
| 4,206,923 | A | * | 6/1980 | Cloutier | 273/160 |
| 4,283,055 | A | * | 8/1981 | Larsen | 273/160 |
| 4,535,993 | A | * | 8/1985 | Topits | 273/265 |
| 4,805,910 | A | * | 2/1989 | Monticolombi et al. | 273/153 R |
| 4,811,948 | A | * | 3/1989 | Gutierrez | 273/156 |
| 5,259,619 | A | * | 11/1993 | Rosewarne | 273/153 R |
| 5,441,260 | A | | 8/1995 | Gogarty | |
| 8,181,961 | B1 | * | 5/2012 | Hall | 273/157 R |
| 2010/0109240 | A1 | * | 5/2010 | Ingman, Sr. | 273/153 R |

FOREIGN PATENT DOCUMENTS

| | | |
|---|---|---|
| FR | 388 893 | 8/1908 |
| WO | 84/01520 A1 | 4/1984 |
| WO | 91/03291 A1 | 3/1991 |
| WO | 92/11071 A1 | 7/1992 |

* cited by examiner

*Primary Examiner* — Steven Wong

(74) *Attorney, Agent, or Firm* — Jason D. Voight

(57) ABSTRACT

The spatial logical and skill improvement game according to the invention is characterized by that the body thereof consists of coaxial body portions arranged at one or multiple layers, and that a labyrinth is formed inside the body and/or the body portions by path sections, pockets and ends, and the game comprises at least one toy element movable through the path sections, pockets, and ends constituting the labyrinth.

20 Claims, 20 Drawing Sheets

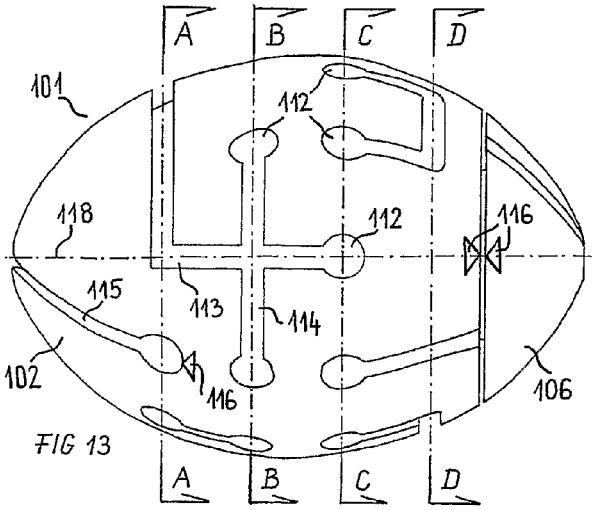
FIG 13
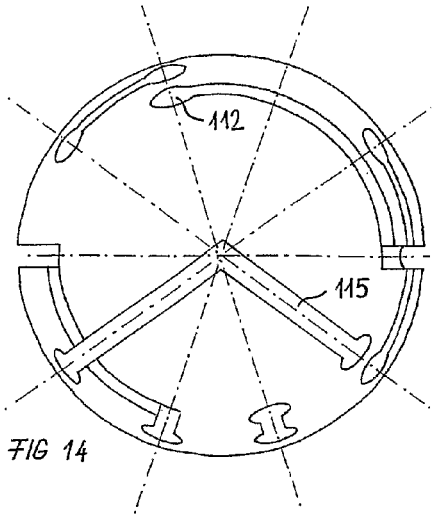
FIG 14
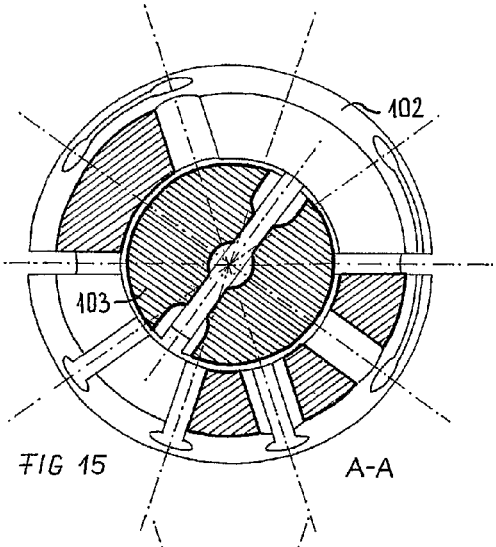
FIG 15 A-A
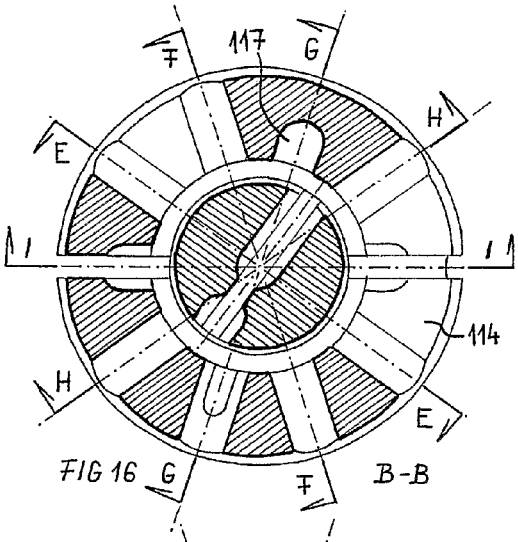
FIG 16 B-B
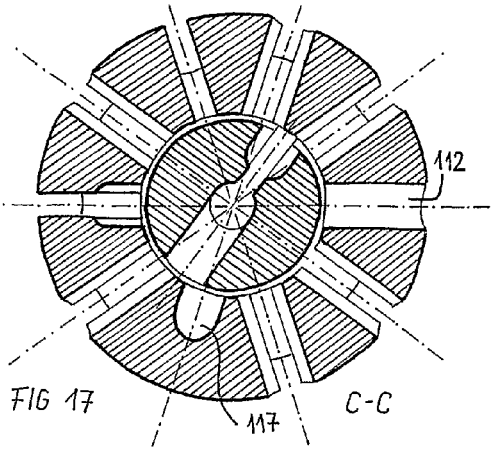
FIG 17 C-C
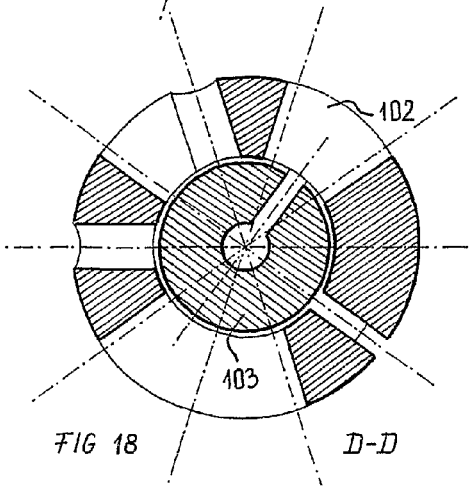
FIG 18 D-D 102
101
103
118
116
116
7
9

A-A

B-B

C-C

D-D

E-E

F-F

G-G

H-H

I-I

J-J

K-K

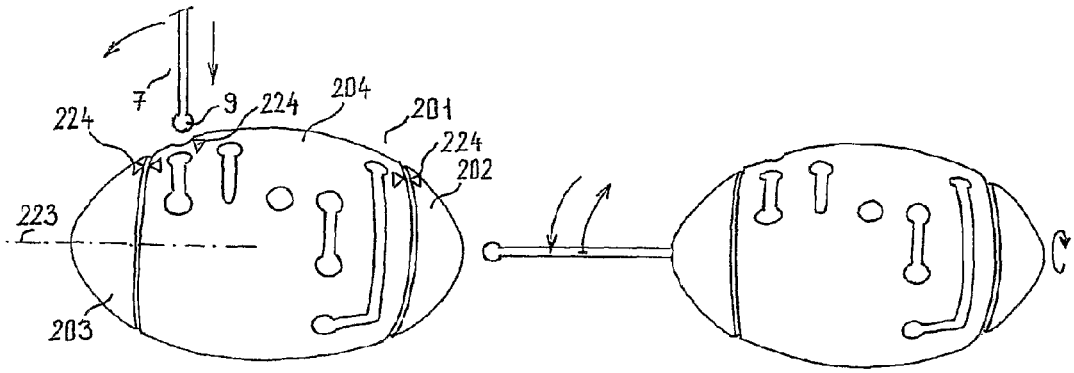
FIG. 47A
FIG. 47B
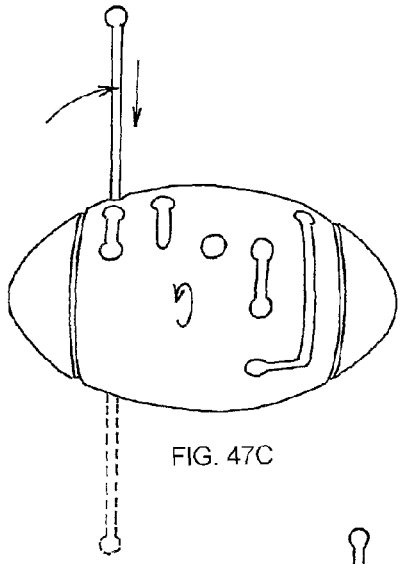
FIG. 47C
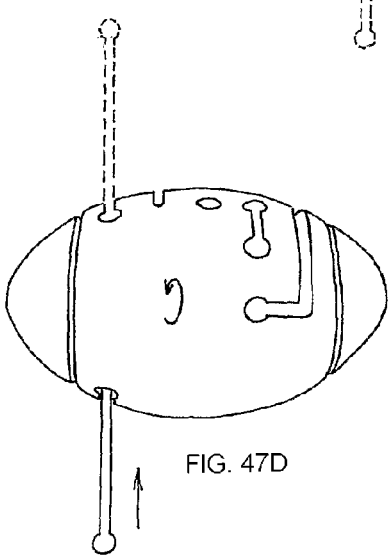
FIG. 47D
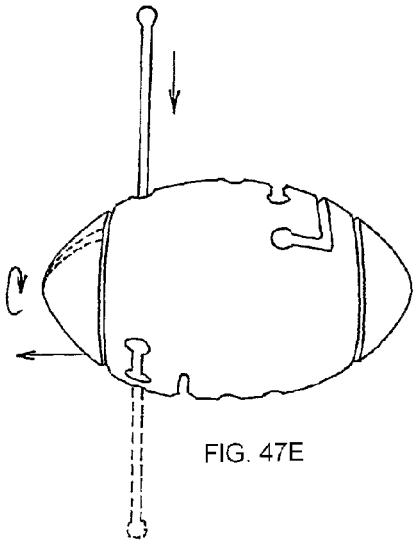
FIG. 47E

SPATIAL LOGICAL AND SKILL IMPROVEMENT GAME, PARTICULARLY A LABYRINTH GAME

This is the national stage of International Application PCT/HU2010/000051, filed May 5, 2010.

FIELD OF THE INVENTION

Spatial logical and skill improvement game, particularly a labyrinth game having regular, irregular or amorphous enveloping shape.

DESCRIPTION OF PRIOR ART

The prior art includes a great number of logical games and toys. The best known of all these is the spatial logical toy disclosed in Hungarian patent HU 170,062. This is a toy having a rounded enveloping body, with cube-formed, coloured-surface elements being disposed on the hexahedral outer surface thereof.

The aim of the game is to solve the puzzle by turning the sides of the cube into a single colour by rotating the toy elements in three spatial directions.

The principle is similar in case of the games disclosed in documents HU 180,612 and HU 180,387 that, however, are not capable of providing a labyrinth-like gameplay.

Hungarian patent HU 183,551 describes a labyrinth-type game consisting of different hexahedral elements that are arranged perpendicularly to three axes and have holes and pockets.

According to patent specification HU 185,746 the labyrinth is formed by a plurality of spatial figures.

Patent specification HU 186,604 discloses a labyrinth game where first the labyrinth should be assembled and only then it is possible to move a ball element through it.

According to patent specification HU 206,637 a puppet with a ball therein is moved through a labyrinth formed by a baseplate with grooves and holes. The puppet is moved by manually tilting the baseplate.

In case of these known games the labyrinth is fully visible for the user, and the toy element to be moved through the labyrinth path is usually a ball that can be moved through the labyrinth path—even in case of spatial labyrinths—by moving the game body.

OBJECTIVE OF THE INVENTION

The objective of the present invention is to provide a spatial logical and skill improvement game, especially a labyrinth game where a toy element shaped to correspond to the spatial arrangement of the labyrinth can be moved through the labyrinth path by moving the toy element, the body, and the body portions constituting the body in a step-by-step, coordinated manner.

The objective of the invention is accomplished by providing a spatial logical and skill improvement game having regular, irregular, or amorphous enveloping shape, and is characterised by that the body thereof consists of coaxial body portions arranged at one or multiple layers to be displaced and/or rotated relative to one another, and that a labyrinth is formed inside the body and the body portions by path sections, pockets and ends, and the game comprises at least one toy element movable through the path sections, pockets, and ends constituting the labyrinth.

In a preferred embodiment of the spatial logical and skill improvement game the body is a single regular body of revolution having path sections and ends disposed therein.

In another preferred embodiment of the spatial logical and skill improvement game the body consists of two portions, the body being constituted by an internal and an external body portion being regular bodies of revolution, and the internal body portion can be pulled out axially to a predetermined pullout length and is freely rotatable about its axis, the internal body portion being formed by two different-diameter cylindrical portions and a terminal portion being connected to the smaller-diameter cylindrical portion at the end thereof opposite the larger-diameter cylindrical portion, with the outer surface of the terminal portion thereof being shaped to correspond to the shape of the external body portion. The internal configuration of the external body portion corresponds to the cylindrical portions of the internal body portion, with respect to the pullout length. Path sections and adjoining broadening ends and pockets are arranged in both the internal body portion and the external body portion.

In a preferred embodiment of the spatial logical and skill improvement game according to the invention the body consists of three coaxially arranged body portions comprised of two concentric cylindrical portions and a coaxial body portion having a shape of a symmetric body of revolution, where the two cylindrical portions are freely rotatable and can be pulled out to a predetermined pullout length and have a terminal portion at their respective opposite ends, and where the two ends of the body portion are arranged to receive a cylindrical portion, the external body portion is terminated by the terminal portions of the cylindrical portions, and the outer surface of the terminal portions of the internal body portions is shaped to correspond to the shape of the external body portion.

In a further preferred embodiment of the spatial logical and skill improvement game, path sections extending in circumferential, axial, and radial directions are disposed in the external and internal body portions of the body.

A preferred embodiment of the spatial logical and skill improvement game has path sections extending along spatial curves.

The toy element of the spatial logical and skill improvement game according to the invention is a stick-shaped body comprising a cylindrical stem and two spherical head portions disposed at the ends of the stem.

In a preferred embodiment of the spatial logical and skill improvement game the toy element is a branching element, or has multiple heads, while in a further preferred embodiment the toy element is curved.

In a further preferred embodiment of the spatial logical and skill improvement game according to the invention the external body portion consists of multiple portions.

A common characteristics of all preferred and advantageous embodiments of the spatial logical and skill improvement game according to the invention is that they are made from a solid material, for instance from wood, metal, glass, or plastic.

BRIEF DESCRIPTION OF THE DRAWINGS

Preferred embodiments of the spatial labyrinth game according to the invention are explained in detail below referring to the accompanying drawings, where FIG. 13 shows the side elevation view of the spatial labyrinth game of FIG. 12, FIG. 14 shows the front view of the spatial labyrinth game of FIG. 12, FIG. 15 is a sectional view of the spatial labyrinth game shown in FIG. 13, taken along plane A-A, FIG. 16 is a sectional view of the spatial labyrinth game shown in FIG. 13, taken along plane B-B, FIG. 17 is a sectional view of the spatial labyrinth game shown in FIG. 13, taken along plane C-C, FIG. 18 is a sectional view of the spatial labyrinth game shown in FIG. 13, taken along plane D-D.

DETAILED DESCRIPTION OF THE INVENTION

The configuration and gameplay of the spatial logical game according to the invention are described below in greater detail.

Figure 1:
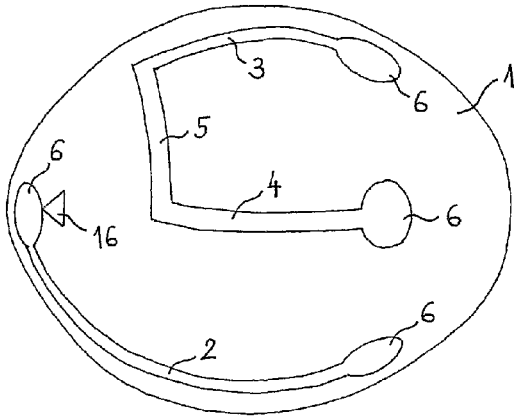
FIG. 1 shows the perspective view of a first, simple preferred embodiment of the spatial labyrinth game according to the invention.
Figure 8:
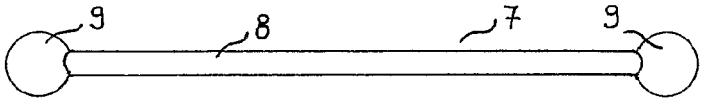
FIG. 8 shows the side elevation view of the element—the stick—that is movable through the spatial labyrinth game of FIG. 1.

FIG. 1 show the perspective view of the simple, static embodiment of the spatial logical game according to the invention. This preferred embodiment is primarily applicable for improving dexterity and spatial vision. The labyrinth game shown in FIG. 1 principally consists of a single body 1 and a toy element 8, with a multiple-section labyrinth path being disposed in the body 1; and with the toy element 8, implemented as stick element shown in FIG. 8, being adapted for being moved through the labyrinth path. The aim of the game is to move the toy element from the start to the end through the spatial path formed in the body 1.

The spatial path disposed in the body 1 is arranged to correspond to the geometry of the stick 7. The stick 7 has heads 9 that prevent the user from removing the stick 7 from the body 1 at an intermediate point of the labyrinth path that is formed inside the body 1 itself.

Certain sections of the path, namely the path sections 2, 3, 4, 5, are visible on the surface of the body 1. It should be noted that path sections 10, 11, 12 and 13 are also located on the surface of the body 1 but they are not visible in the view shown in the drawing. The path sections 2, 3, 4 have broadening ends 6 configured to correspond to the geometry of the head portion 9 of the stick 7. The path sections are either apparently independent (see path section 2) or visibly adjoining to one another (see path sections 3, 4, 5). The role of the path sections 2, 3, 4, 5, as well as that of the path sections 10, 11, 12 not visible in the drawing will be addressed later.

Figure 2:
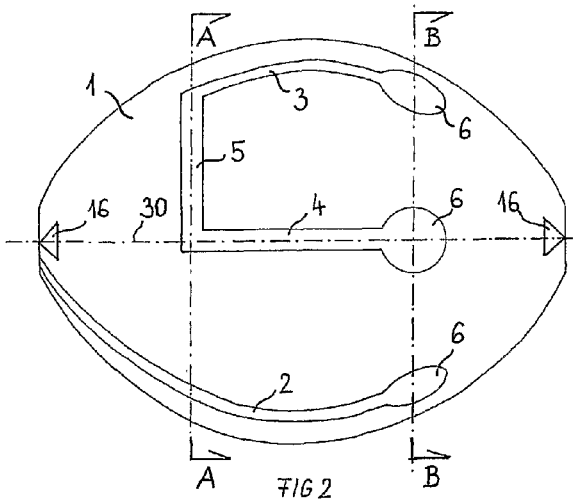
FIG. 2 is the side elevation view of the spatial labyrinth game shown in FIG. 1.
Figure 3:
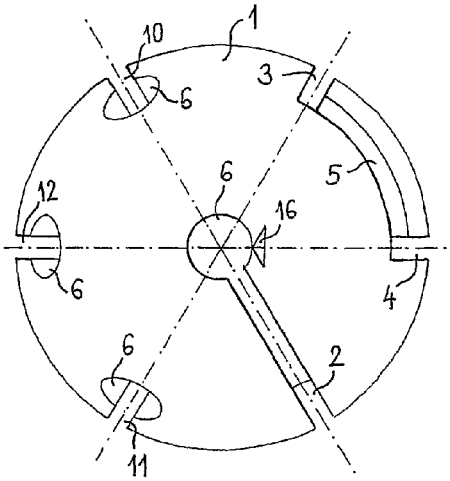
FIG. 3 is the front elevation view of the spatial labyrinth game shown in FIG. 1.

FIG. 2 shows the side elevation view of the spatial labyrinth game of FIG. 1, while FIG. 3 shows the front elevation view of the spatial labyrinth game of FIG. 1. As it can be seen in FIG. 3, further path sections 10, 11, 12, 13 having broadening ends 6 are arranged in other parts of the body 1 as well.

Figure 4:
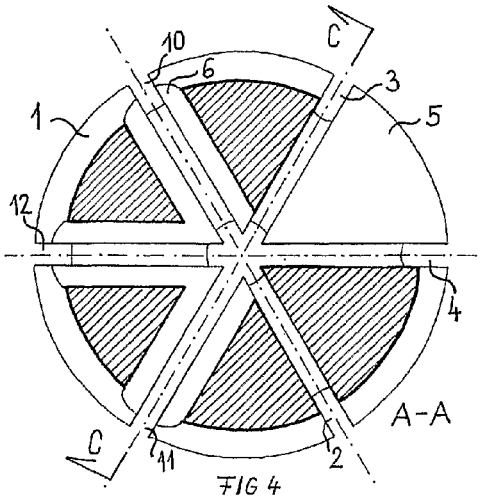
FIG. 4 is a cross-sectional view of the spatial labyrinth game shown in FIG. 2, taken along plane A-A.
Figure 5:
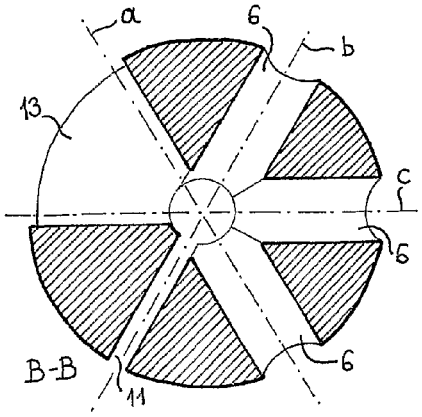
FIG. 5 is a cross-sectional view of the spatial labyrinth game shown in FIG. 2, taken along plane B-B.

FIG. 4 is a cross-sectional view of the spatial labyrinth game shown in FIG. 2, taken along plane A-A. As the plane A-A intersects path section 5, the interconnection and relative orientation of path section 5 to other path sections 10, 11, 12 can be readily seen. FIG. 5 is a cross-sectional view of the spatial labyrinth game shown in FIG. 2, taken along plane B-B. Section plane B-B intersects the ends 6 of path sections 2, 3, 4, and thus the configuration of the radial-direction continuation of the ends 6 towards the axis of the body 1 is shown in the drawing.

Figure 6:
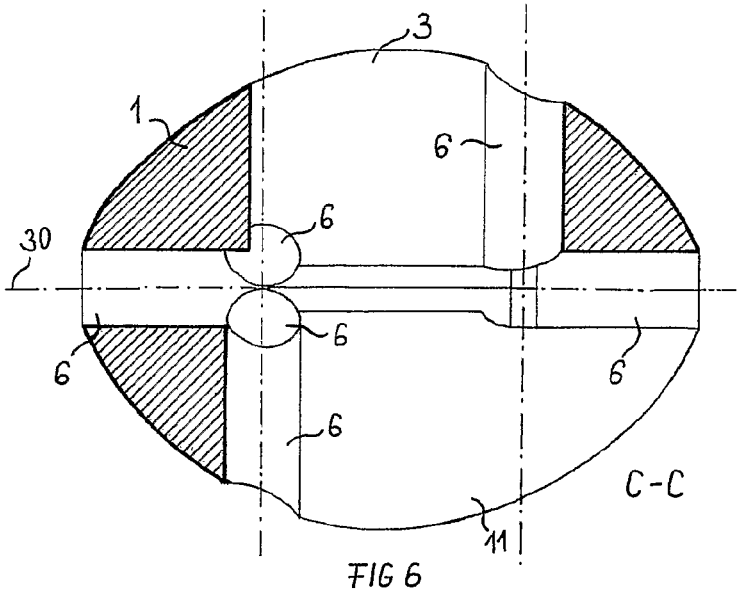
FIG. 6 is a cross-sectional view of the spatial labyrinth game shown in FIG. 4, taken along plane C-C.

FIG. 6 shows the longitudinal section of the spatial labyrinth game illustrated in FIG. 4, showing the interconnection of the path sections 3 and 11.

Figure 7:
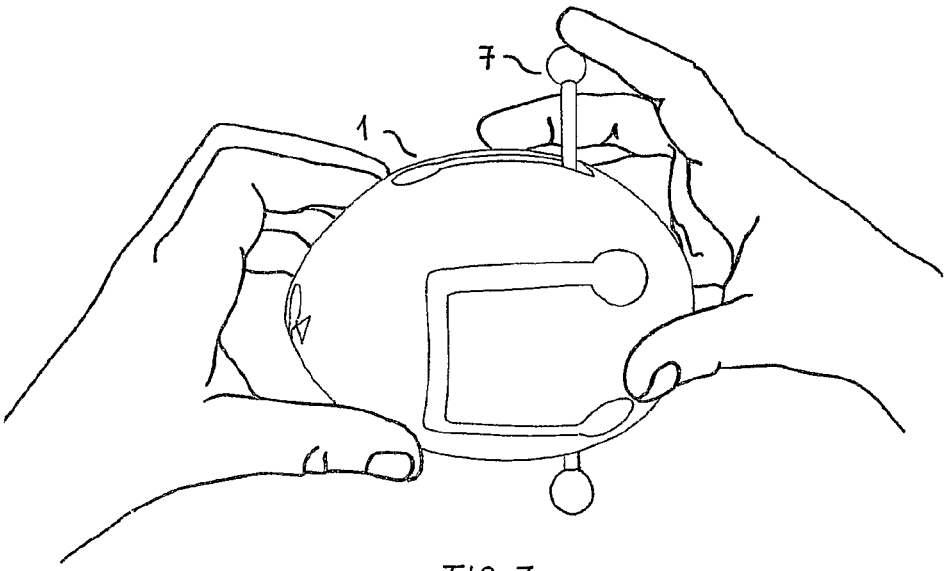
FIG. 7 shows the spatial labyrinth game of FIG. 1 together with the stick in an in-game situation.
Figure 9:
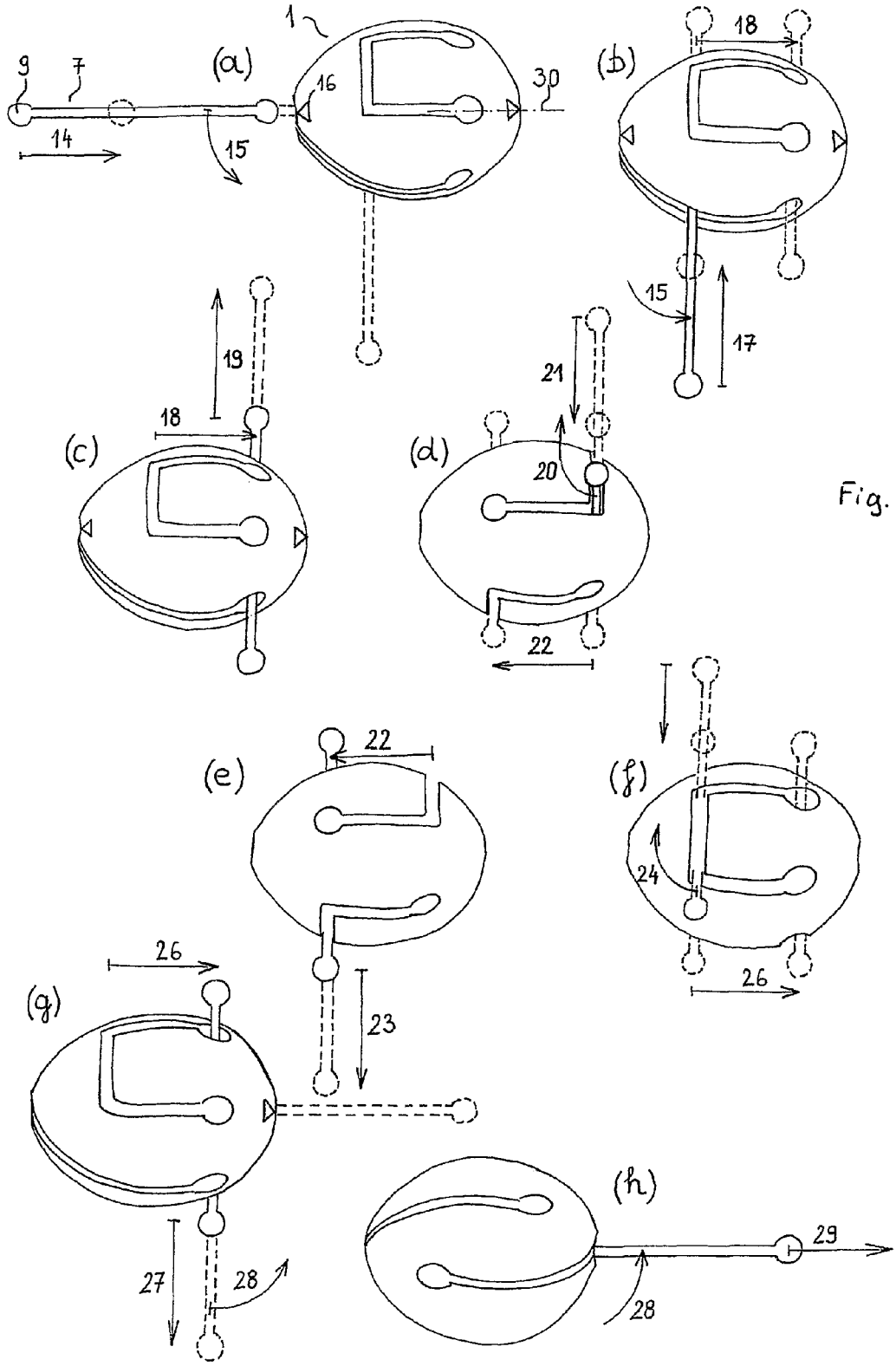
FIG. 9 shows the moves of the spatial labyrinth game of FIG. 1 through which the stick is moved.

In FIG. 7 the spatial labyrinth game is shown in a user's hands, with the stick 7 being in an in-game position.

The simple labyrinth game shown in FIG. 1 is configured on the basis of the association of two plane systems. The first plane system is generated by two lines set perpendicularly to the axis 30 of the body 1, one laying in section plane A-A and one laying in plane B-B, while the other plane system consists of three radially extending planes disposed with uniform angular spacing.

This radial plane system—consisting of radial planes a, b, c—is illustrated in FIG. 5. The starting point, as well as the turning points and the ends 6 of the planned labyrinth path are generated by the intersection lines of the two plane systems. The starting point 16 and end point of the game path are located on the axis 30 of the body 1 of the labyrinth game.

To move the toy element—the stick 7—through the labyrinth path it is necessary to perform axial direction moves directed backward and forward relative to the axis 30 of the body 1 of the spatial labyrinth game, as well as moves that involve pushing the toy element from one side of the body 1 to the other.

According to a preferred embodiment shown in the drawings the stick 7 consist of a cylindrical stem 8 and two head portions 9 disposed at both ends of the stem 8. The head portions 9 have spherical configuration.

The stick 7 is inserted in the direction of the arrow 14 into the end 6 at one extremity of the axis of the body 1. This is one of the starting points 16 of the game. The stick 7 inserted into the body 1 at the starting point 16 is moved along path section 2 in the direction indicated by the arrow 15 (*a*) to bring it in a position where the stem 8 of the stick 7 is perpendicular to the axis 30 of the body 1. The stick 7 is then pushed through the body 1 in the direction of arrow 17. In the resulting position the head portions 9 of the stick 7 extend from the top and bottom part of body 1. Now the stick 7 is moved along the axis of the body 1 in the direction of arrow 18 (*b*), and then moved upwards perpendicularly to the axis of the body 1 in the direction of arrow 19 (*c*). The next move involves rotating the stick 7 in the direction of arrow 20 and then moving it upwards perpendicularly to the axis of the body 1 in the direction of arrow 21. In the resulting position the head portions 9 of the stick 7 once again extend from the body 1, and are located in a new path section that is visible on the surface of the body 1. The stick is then pushed in the direction of arrow 22 (*d*), and moved downwards perpendicularly to the axis of the body 1 in the direction of arrow 23. Then the stick 7 is rotated in the direction of arrow 24 to an orientation perpendicular to the axis 30, is pushed halfway into the body 1 in the direction of arrow 25, and then moved in a plane containing the axis 30, keeping the previous orientation, in the direction of arrow 26. Subsequently the stick 7 is moved perpendicularly to the axis of the body 1 in the direction of arrow 27, and is moved (rotated) further along a new path section (g). With this move the game of moving the stick 7 through the path formed in the body 1 is completed, and the stick 7 is removed from the body 1 in the direction of arrow 29 at the end point.

As it has already been mentioned, the embodiment shown in FIG. 1 is the simplest, static version of the spatial labyrinth game according to the invention, where there is only a single possible path through which the stick 7 can be moved.

Figure 10:
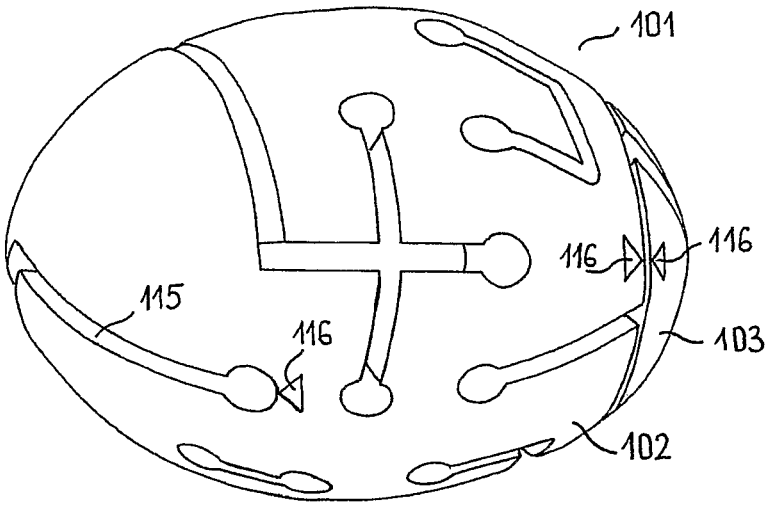
FIG. 10 shows the perspective view of a second, dynamic, preferred embodiment of the spatial labyrinth game according to the invention.
Figure 11:
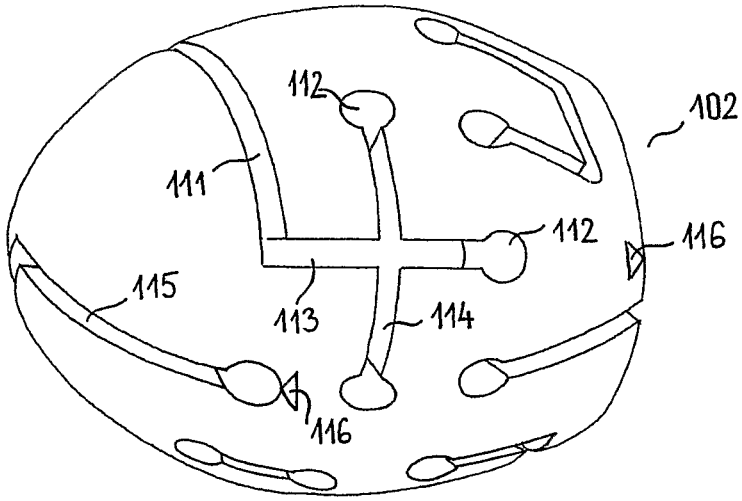
FIG. 11 is the perspective view of the external body portion of the spatial labyrinth game of FIG. 10.

FIG. 10 shows a preferred embodiment of the spatial labyrinth game that is capable of providing a dynamic gameplay, where there is still a single possible path through the labyrinth formed in the body 1. It has to be noted here that at each stage of the game there are possible moves that lead to an incorrect path, from which backward moves are needed to find the right path again. The body 101 of the spatial labyrinth game of FIG. 10 consists of two portions: body portions 102 and 103. Body portion 102 principally constitutes the external element of the game.

Figure 12:
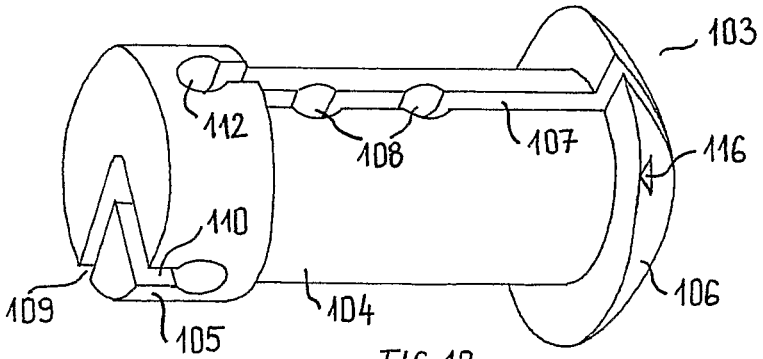
FIG. 12 is the perspective view of the internal body portion of the spatial labyrinth game of FIG. 10.
Figure 19:
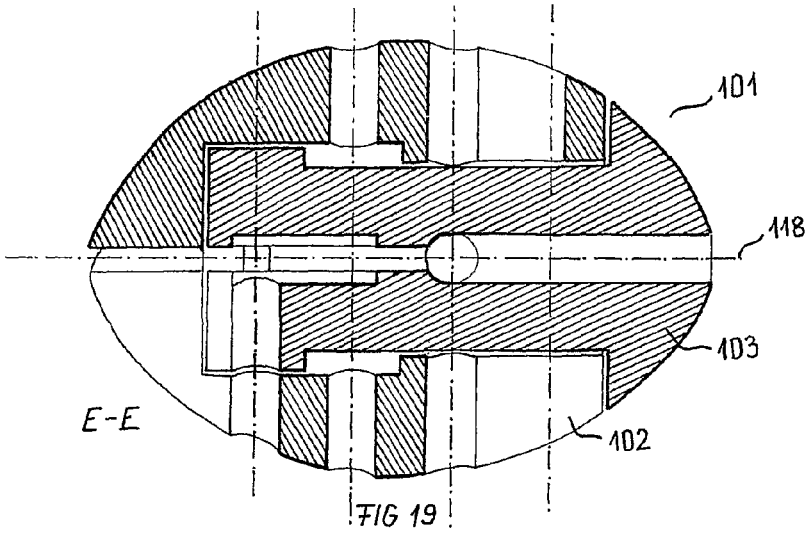
FIG. 19 is a sectional view of the spatial labyrinth game shown in FIG. 16, taken along plane E-E.
Figure 20:
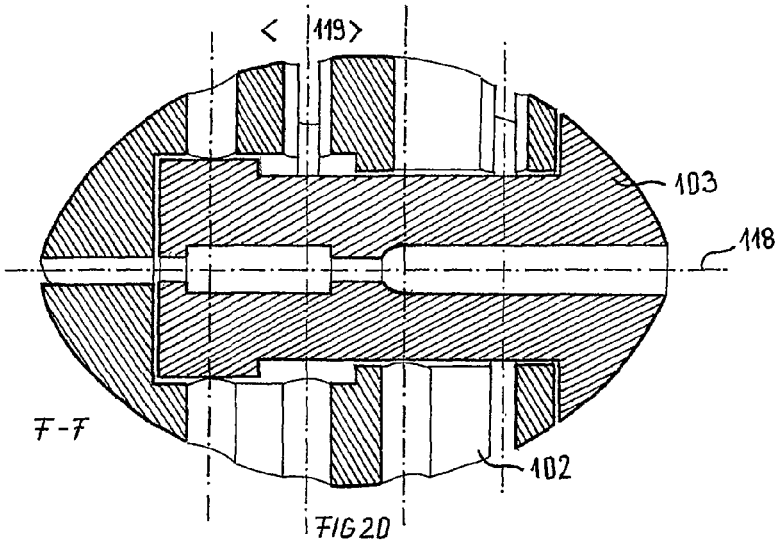
FIG. 20 is a sectional view of the spatial labyrinth game shown in FIG. 16, taken along plane F-F.
Figure 21:
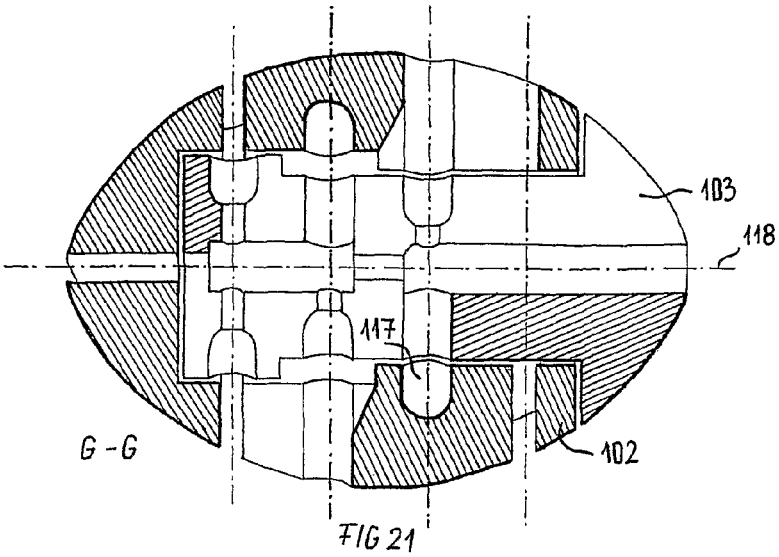
FIG. 21 is a sectional view of the spatial labyrinth game shown in FIG. 16, taken along plane G-G.

The body portions 102 and 103 have a common axis of rotation, both body portions containing path sections that make up the labyrinth path. As it is best seen in FIG. 12, the body portion 103 is a cylindrical body consisting of a cylindrical portion 104, another, shorter but larger-diameter cylindrical portion 105 arranged coaxially with cylindrical portion 104, and a terminal portion 106 that is connected to the other end of the cylindrical portion 104 opposite the cylindrical portion 105 and has a shape arranged to complement the surface shape of body portion 102.

Figure 22:
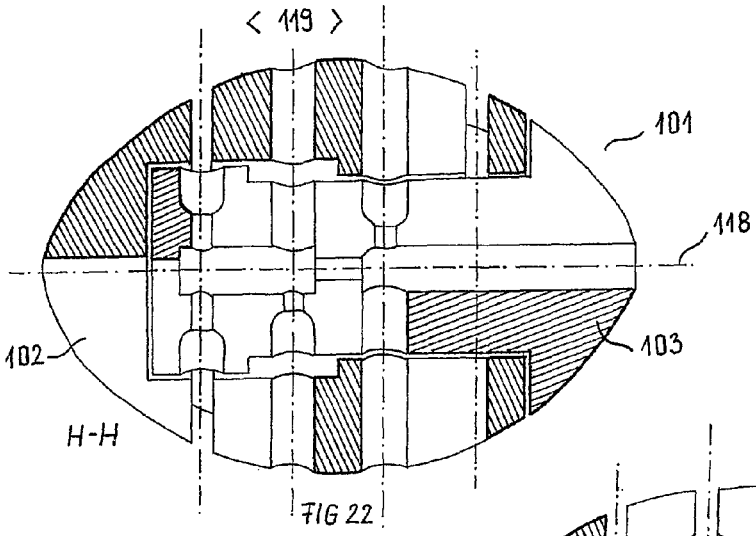
FIG. 22 is a sectional view of the spatial labyrinth game shown in FIG. 16, taken along plane H-H.
Figure 23:
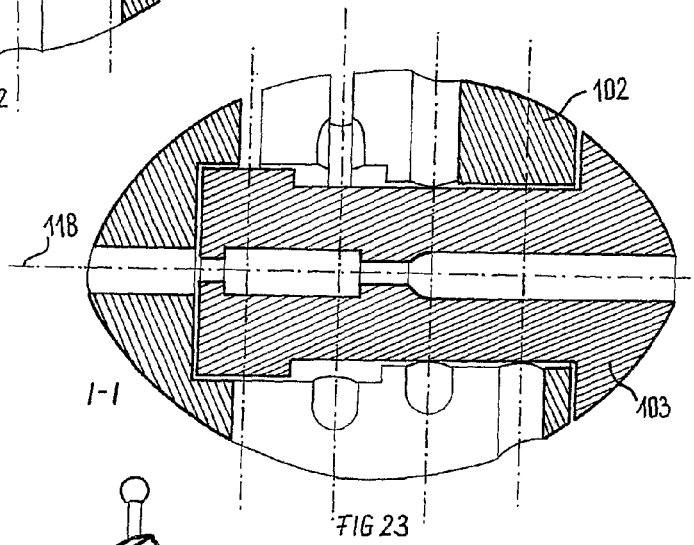
FIG. 23 is a sectional view of the spatial labyrinth game shown in FIG. 16, taken along plane I-I.

The body portion 102 is a body of revolution arranged coaxially with body portion 103, with the diameter of its interior bore being dimensioned with respect to the diameter of cylindrical portions 104, 105 such that the two body portions 102, 103 may be moved relative to each other. The pullout length 119 (see FIG. 22) is determined by the different axial dimensions of cylindrical portions 104, 105 and the interior bore.

The cylindrical portions 104, 105 comprise axial-direction path sections 107, 109, 110 having broadening ends 108 corresponding to the shape of the stick.

The external body portion 102 of the body 101 also comprises path sections 111, 113, 114, 115 of the labyrinth path through which the stick is moved. These path sections 111, 113, 114, 115 are also terminated by broadening ends 112. Some path sections are arranged to be continuations of other path sections, while others are arranged to intersect each other.

Thus the body 101 of the spatial labyrinth game consists of body portions 102, 103, where body portion 103 is disposed partially inside body portion 102, and the terminal portion 106 of body portion 103 abuts against body portion 102 in the base (initial) position such that the body 101 has a uniform surface. The terminal portion 106 also comprises a path section and end 112.

In case the stick is not inserted into the body 101, the body portion 103 is freely rotatable in body portion 102, and can be pulled out therefrom to a predetermined pullout length 119 along the axis of the body 101. The rotatability and the axial-direction displaceability of the body portion 103 are inevitable for successfully moving the stick through the labyrinth path. In order to be able to move the stick through the dynamic spatial labyrinth path, the user has to recognise and—by moving the body portions—"build" the right path move by move corresponding to the current position and orientation of the stick (we will address this point in more detail later).

FIG. 13 shows the side view of the spatial labyrinth game of FIG. 10, showing the path sections 113, 114, 115 formed in the external body portion 102, as well as their ends 112. The body portion 102 and the terminal portion 106 both have a marking 116 indicating the initial position of the game. The game can be started by inserting the stick at the opposite side of the body 101.

FIG. 14 shows the front elevation view of the spatial labyrinth game according to FIG. 10, showing further path sections and their ends.

FIG. 15 is a sectional view of the spatial labyrinth game shown in FIG. 10, taken along plane A-A. The drawing shows the relative positions of path sections disposed in the external body portion 102 and internal body portion 103.

FIGS. 16, 17, and 18, respectively show sectional views of the game of FIG. 10 taken along planes B-B, C-C, and D-D, illustrating the relative positions of further path sections disposed in the external body portion 102 and internal body portion 103, as well as a pocket 117 not visible from outside that is shaped to correspond to the size of the head portion of the stick.

FIGS. 19, 20, 21, 22, 23 respectively show sectional views of the game of FIG. 16, taken along planes E-E, F-F, G-G, H-H, and I-I, illustrating the arrangement and relative positions of path sections disposed in the body portions 102, 103.

As it is clearly seen in the drawings, the planned spatial labyrinth path of the game comprises:

- path sections pointing backward and forward relative to the axis 118 of the body 101,
- path sections, pockets, and ends that are not visible for the user but can be "traced" utilising the stick,
- partially self-intersecting path sections,
- path sections that provide the possibility for pushing the stick through the body 101 in oblique directions relative to a plane perpendicular to the axis 118 of body 101.

Figure 24:
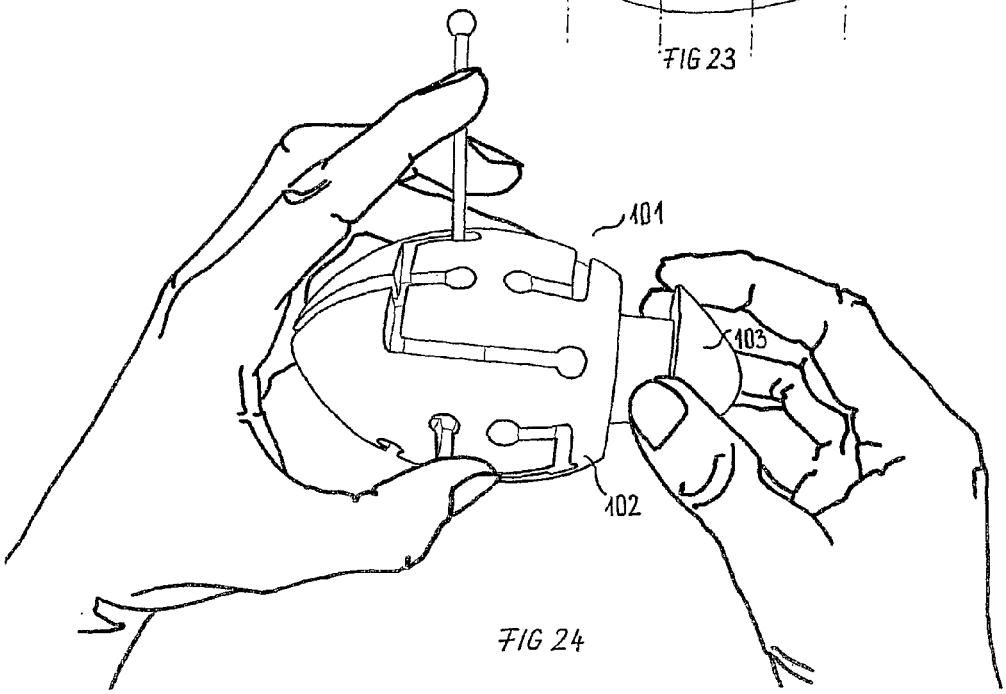
FIG. 24 shows the spatial labyrinth game of FIG. 10 together with the stick in an in-game situation.
Figures 25A, 25B, 25C, 25D, 25E, 25F, 25G, 25H:
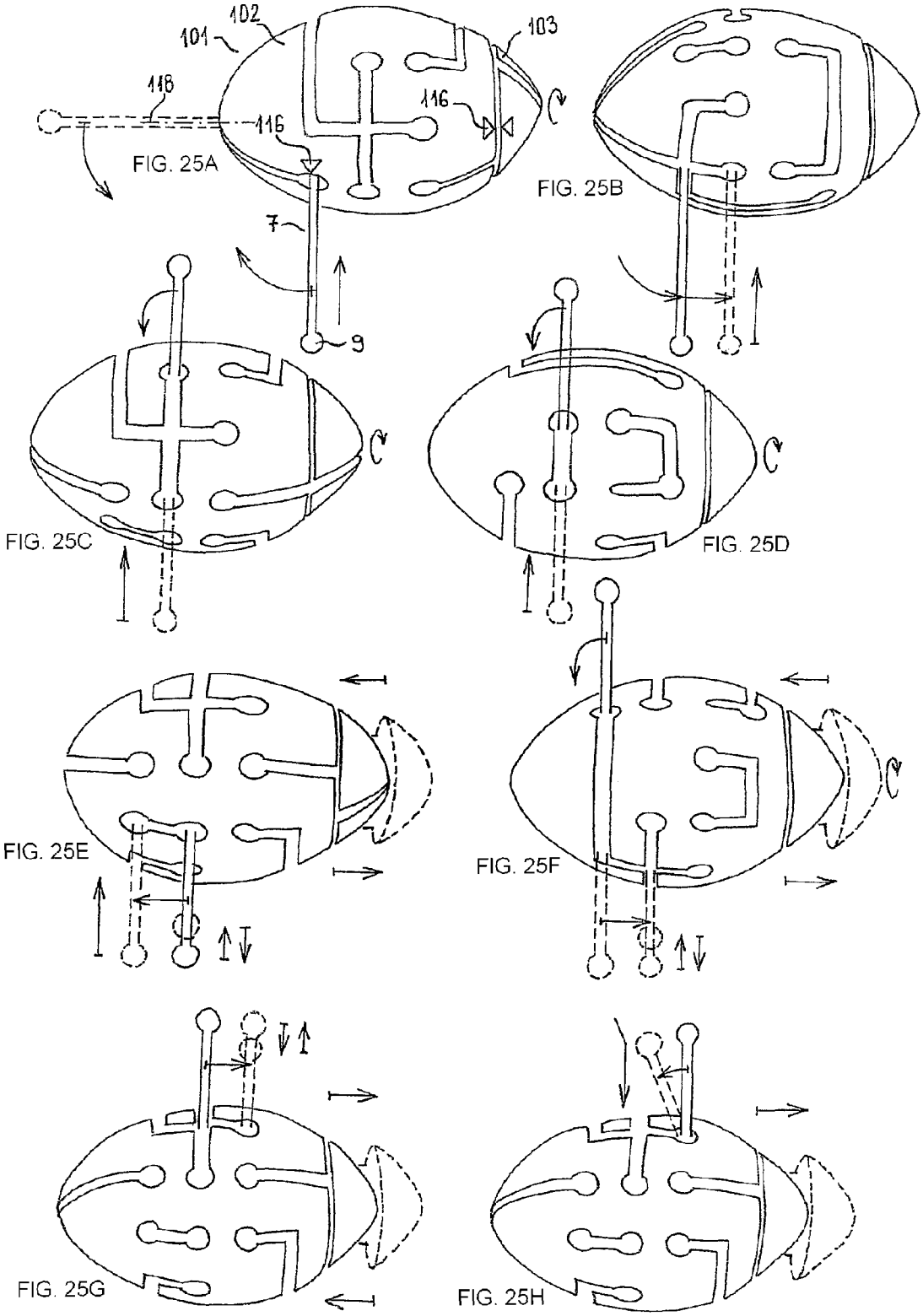
FIGS. 25A to 25W show the steps of the spatial labyrinth game of FIG. 10 through which the stick is moved.
Figure 25I:
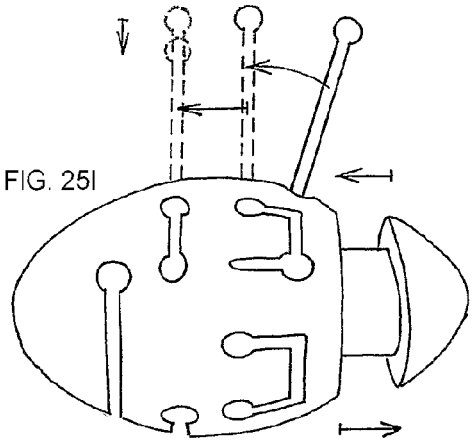
Figure 25J:
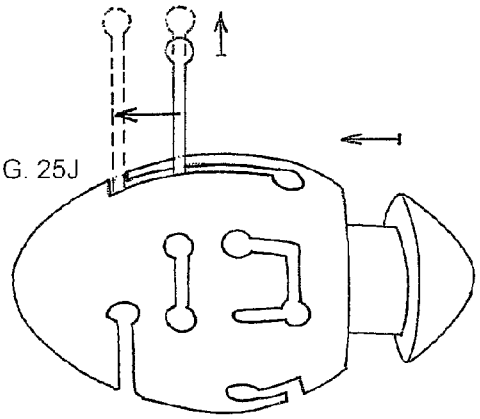
Figure 25K:
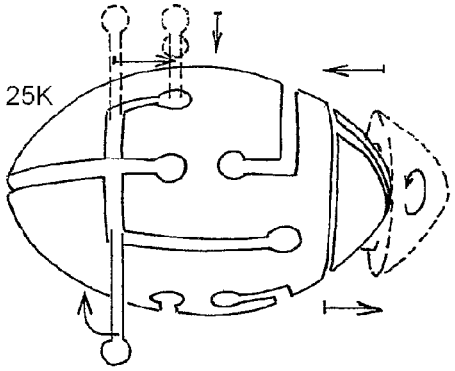
Figure 25L:
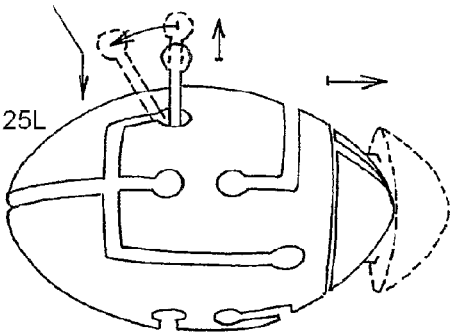
Figure 25M:
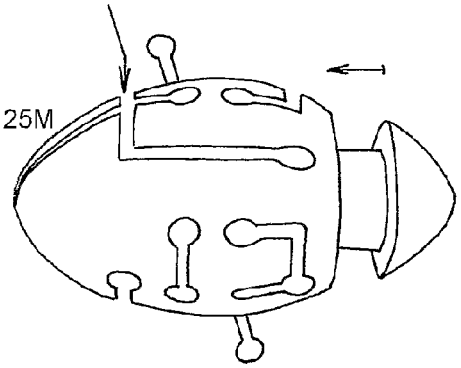
Figure 25N:
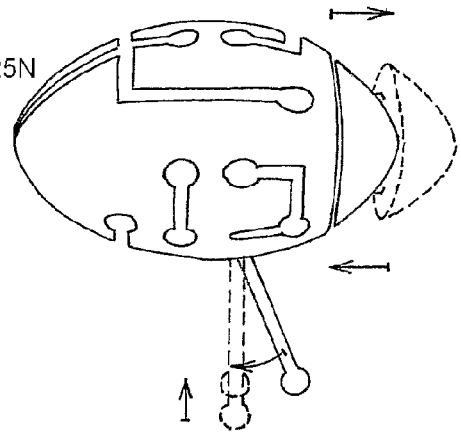
Figure 25O:
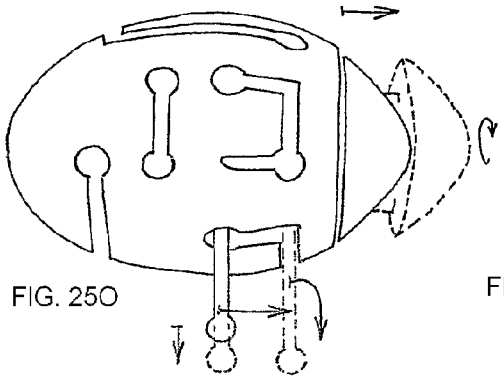
Figure 25P:
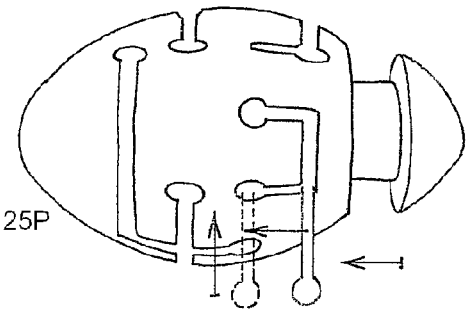
Figure 25Q:
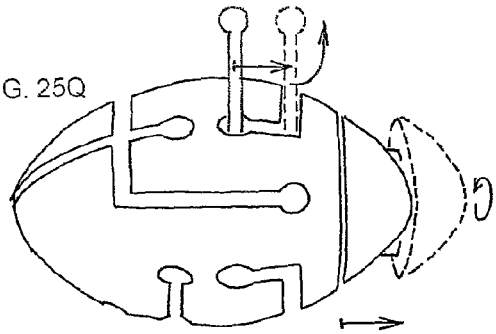
Figure 25R:
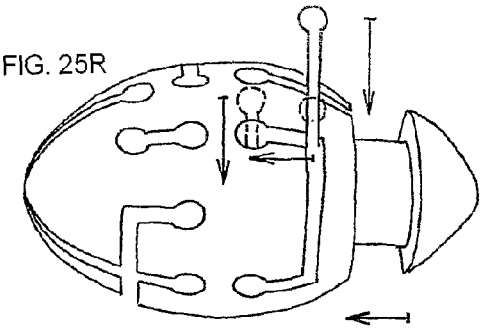
Figure 25S:
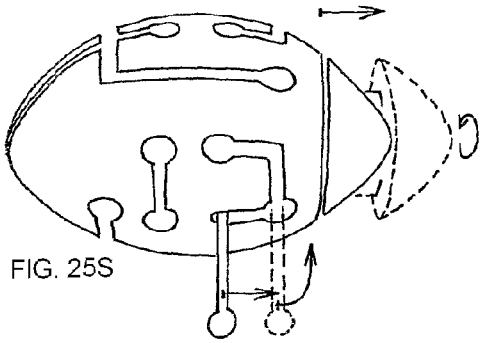
Figure 25T:
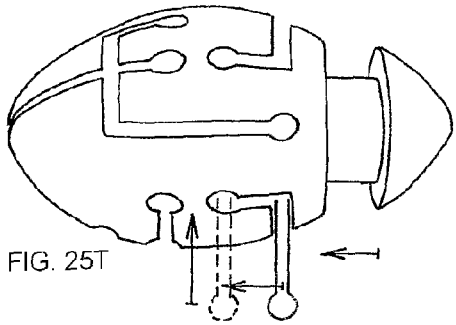
Figure 25U:
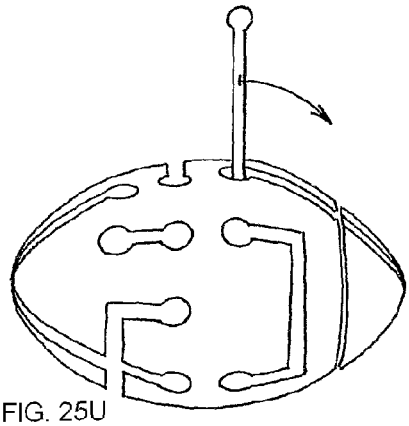
Figure 25V:
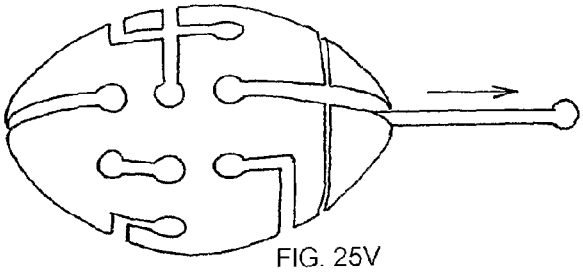
Figure 25W:
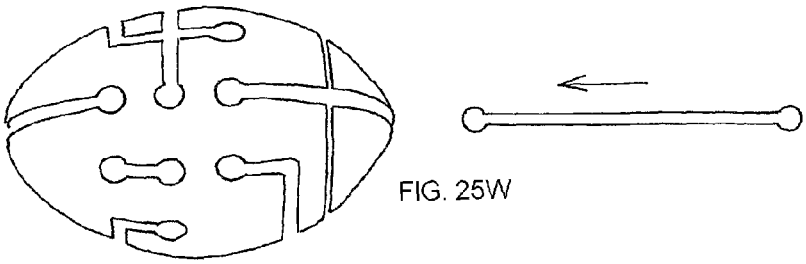

FIG. 24 shows the spatial labyrinth game of FIG. 10 in a user's hands with the stick in an in-game position, and the body portion 103 being in a pulled-out position.

Moves of the game of moving the stick through the labyrinth from its entry point to its exit point are explained below referring to FIG. 25.

To start the game, first the markings 116 on the body portions 102, 103 should be aligned by rotating the portions relative to each other. After the alignment is made, one of the head portions 9 of the stick 7 is inserted perpendicularly to the axis 118 into the body portion 102 at the starting point indicated by the marking 116, and is rotated to an orientation parallel with the axis 118. It has to be noted that the configuration of the stick 7 is identical to the stick shown in FIG. 8, but the stem 8 and head portions 9 are dimensioned differently to correspond to the body arrangement shown in the drawing. The body portion 103 is thereafter rotated in a clockwise direction, and, progressing further along path sections 109, 115 the stick 7 is rotated back to an orientation perpendicular to the axis 118 (*a*), and then moved further along the axis 118. The stick 7 is then pushed in a direction perpendicular to the axis 118 to the other side of the body portion 102 (*b*), and the body portion 103 is rotated clockwise together with the stick. Now the stick 7 is pushed back (c) into the body, and rotated again clockwise together with the body portion 103. Thereafter the stick 7 is pushed through the body until it stops (d), and then the head portion 9 of the stick 7 (residing in body portion 103) is inserted into the body portion 102, and the body portion 103 is pulled outwards. The stick 7 is now pulled outwards until it stops, is displaced along the axis 118 together with the body portion 103, and then is pushed in a direction perpendicular to the axis 118 to the other side of the body portion 102 (*e*). The body portion 103 is then rotated in a clockwise direction and pulled outwards together with the stick 7, and then the head portion 9 of the stick 7 (now residing in the body portion 103) is inserted into the body portion 102. The body portion 103 is pushed back to its initial position, and the head portion 9 of the stick 7 is pulled back into the body portion 103 (*f*). The body portion 103 is then moved together with the stick 7, and the head portion 9 of the stick 7 is pushed into the body portion 102, followed by pushing the body portion 103 back. Thereafter, the head portion 9 is pulled back into the body portion 102 (*g*), and then the body portion 103 is pulled outwards together with the head portion 9, while tilting the stick at a non-perpendicular angle with respect to the axis 118 of the game, and pushing the stick 7 in a direction perpendicular to the axis to the other side while keeping its orientation (h). The stick 7 is then rotated so that it is perpendicular again to the axis 118, and it is displaced together with the body portion 103 along the axis 118. The head portion 9 of the stick 7, residing now in the body portion 103 is then pushed towards the axis 118 into the body portion 102. Then the body portion 103 is pulled outwards (i), and the head portion 9 of the stick 7 is pulled back and moved together with the body portion 103 (*j*). Now the body portion 103 and the stick 7 are together rotated in an anticlockwise direction, and are displaced in a direction parallel with the axis 118. The head portion 9 of the stick 7 is pushed in the body portion 102 and then the body portion 103 is pushed back in place (k). Then the head portion 9 of the stick 7 is pulled back and the body portion 103 is pulled outwards again, while the stick 7 becomes tilted.

In the next move the tilted stick 7 is pushed in a direction perpendicular to the axis 118 of the body to such an extent that both head portions 9 extend from the body portion 102 (*l*). Now the body portion 103 is pushed back, and the stick 7 is pushed further through the body until it stops (m). The body portion 103 is then pulled outwards again together with the stick 7, and thereby the stick 7 turns again into an upright position that is perpendicular to the axis of the body. Subsequently, the stick 7 is pushed in the direction of its own axis until it stops, and thereby the head portion 9 thereof (residing at the beginning of the move in the body portion 103) is moved to a concealed pocket that is disposed in the body portion 102 and is not visible from outside. The body portion 103 is then pushed back in place (n), and the head portion 9 of the stick 7 is pulled back into the body portion 103, and the body portion 103 is pulled outwards together with the stick 7. Now the body portion 103 is rotated together with the stick 7 in a clockwise direction (o), and pushed back. The stick 7 is then pushed to the other side of the body (p). Again, the body portion 103 is pulled outwards together with the stick 7, and is rotated in an anticlockwise direction (q). After the rotation move the stick 7 is pushed towards the axis 118 to such an extent that both head portions 9 extend from the body, and the stick 7 is then moved together with the body portion 103 along the axis 118. The stick 7 is now pushed further towards the axis 118 until it stops (r), and, together with the body portion 103, is moved in a direction parallel with the axis 118. Thereafter the body portion 103 is rotated in a clockwise direction together with the stick 7 (*s*), and is pushed back into the initial position together with the stick 7 that is pushed through the body to the other side thereof (t). Finally, the stick 7 is rotated such that it becomes coincident with the axis 118 of the body 101 (*u*), and is removed from the body in the direction of the arrow (v).

Moves of the game may be executed in a reverse order, which means that the game should be started at the above described exit point (w).

Figure 26:
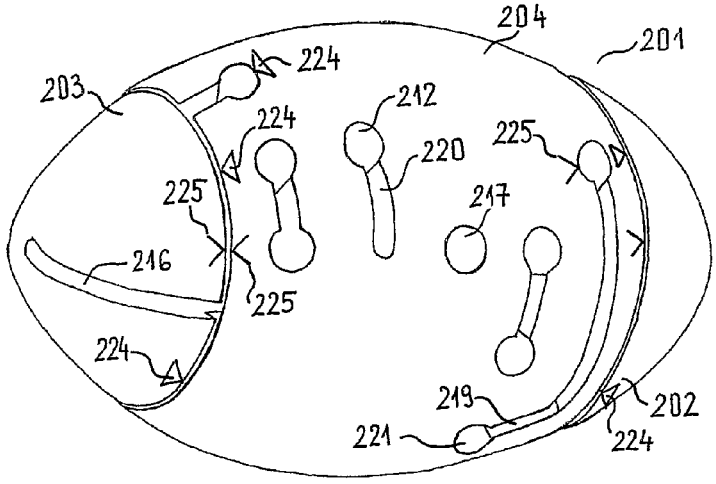
FIG. 26 shows the perspective view of a further dynamic preferred embodiment of the spatial labyrinth game according to the invention.

FIG. 26 shows another preferred embodiment of the dynamic version of the spatial labyrinth game according to the invention.

Figure 28:
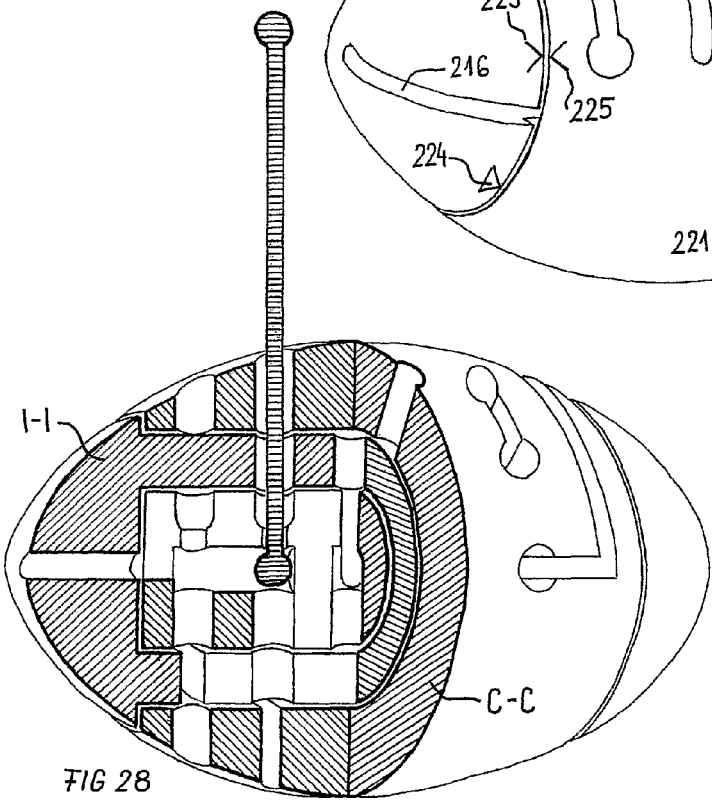
FIG. 28 shows a partial sectional view of the spatial labyrinth game of FIG. 26.
Figure 46:
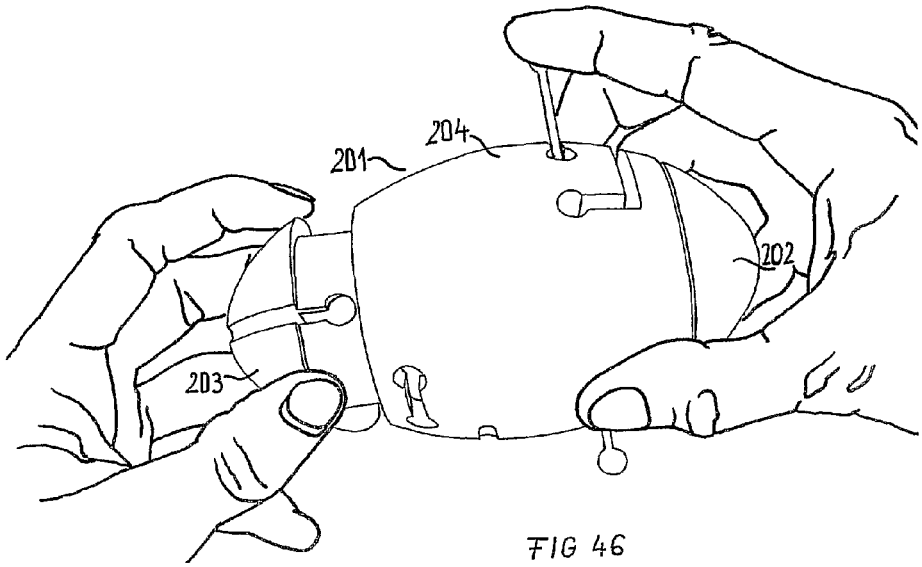
FIG. 46 shows the spatial labyrinth game of FIG. 26 together with the stick in an in-game situation.

The body 201 of the spatial labyrinth game according to FIG. 26 consists of three coaxial body portions 202, 203, 204. FIG. 28 shows a partial sectional view of the body 201, illustrating the arrangement and relative positions of the path sections disposed in the body portions 202, 203, 204.

Figure 30:
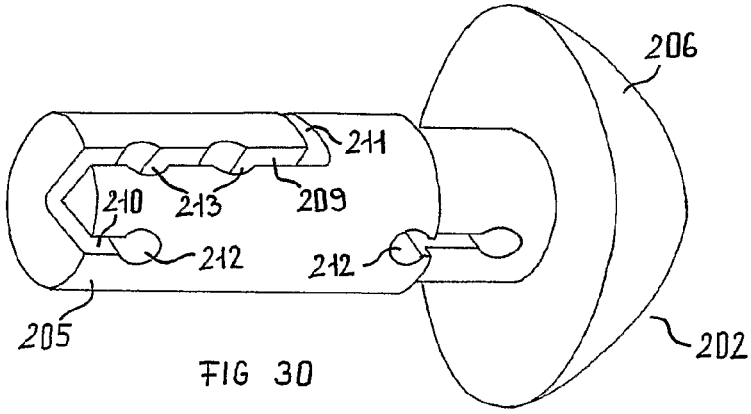
FIG. 30 shows the axonometric view of the second internal body portion of the spatial labyrinth game shown in FIG. 26.
Figure 29:
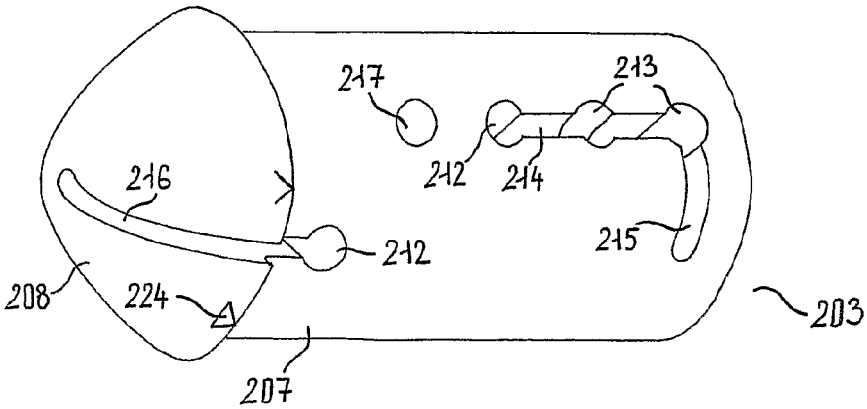
FIG. 29 shows the axonometric view of the first internal body portion of the spatial labyrinth game shown in FIG. 26.

In FIG. 28 the stick 7 is shown in an intermediate position. The individual elements of the spatial labyrinth game of FIG. 26 are explained in detail referring to FIGS. 27, 29, 30.

Figure 27:
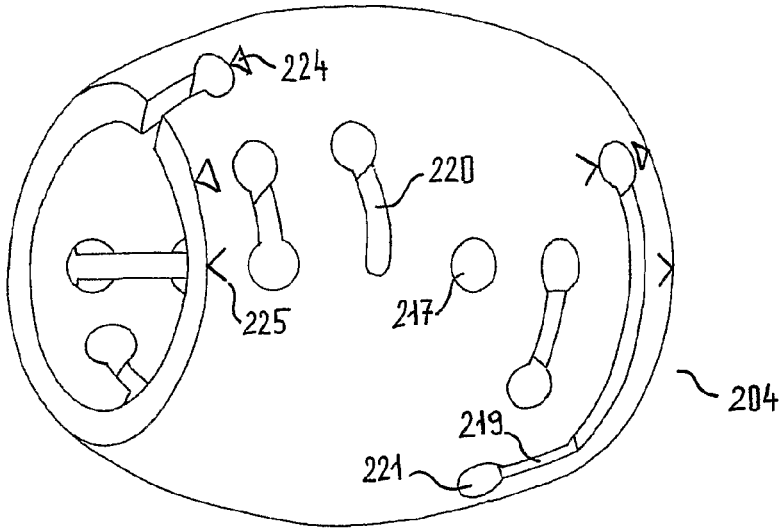
FIG. 27 shows the axonometric view of the external body portion of the spatial labyrinth game shown in FIG. 26.

FIG. 27 shows the axonometric view of the external body portion 204. The body portion 204 is a shell-like element comprising path sections 219, 220 that extend in axial, radial, and circumferential directions and have broadening ends 221. Some path sections of the body portion 204 have broadening ends at both of their extremities but there are some path sections that have a broadening end at only one of their extremities. The path ends 221 provide the possibility for pushing the stick through the body from one side to the other in a radial direction.

A body portion 203, arranged coaxially with body portion 204 adjoins to one end of the body portion 204. This body portion 203 consists of a cylindrical portion 207 having bores and a terminal portion 208 terminating the body portion 203 at one extremity, where the terminal portion 208 is arranged to correspond to the external surface of the body portion 204. The cylindrical portion 207 of the body portion 203 comprises path sections 214, 215 having portions 213 arranged to correspond to the diameter of the heads of the stick.

The terminal portion 208 also has a path section 216.

The third body portion 202 of the spatial labyrinth game is arranged to be inserted into the body portion 203.

The body portions 202, 203 inserted into the body portion 204 are freely rotatable on their own, and may be pulled out independently in an axial direction from the body portion 204 to a predetermined length.

Figure 39:
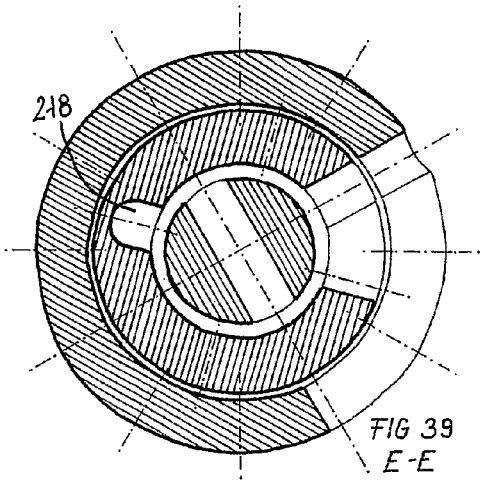
FIG. 39 is a sectional view of the spatial labyrinth game shown in FIG. 31, taken along plane E-E.
Figure 40:
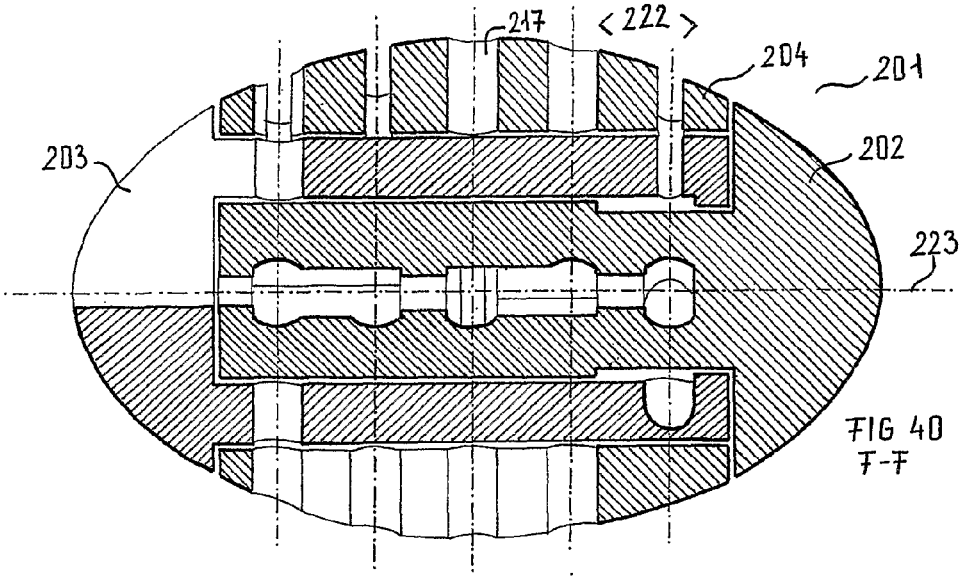
FIG. 40 is a sectional view of the spatial labyrinth game shown in FIG. 37, taken along plane F-F.
Figure 41:
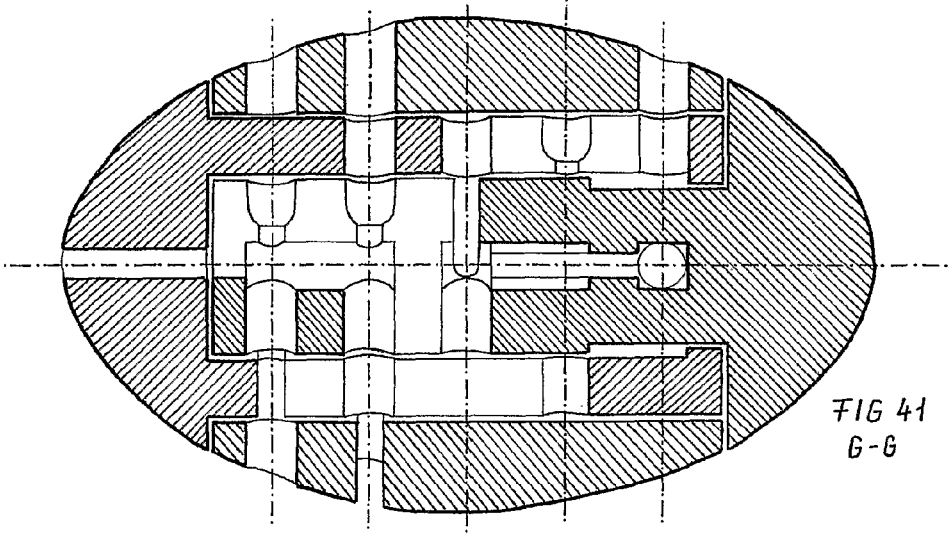
FIG. 41 is a sectional view of the spatial labyrinth game shown in FIG. 37, taken along plane G-G.
Figure 42:
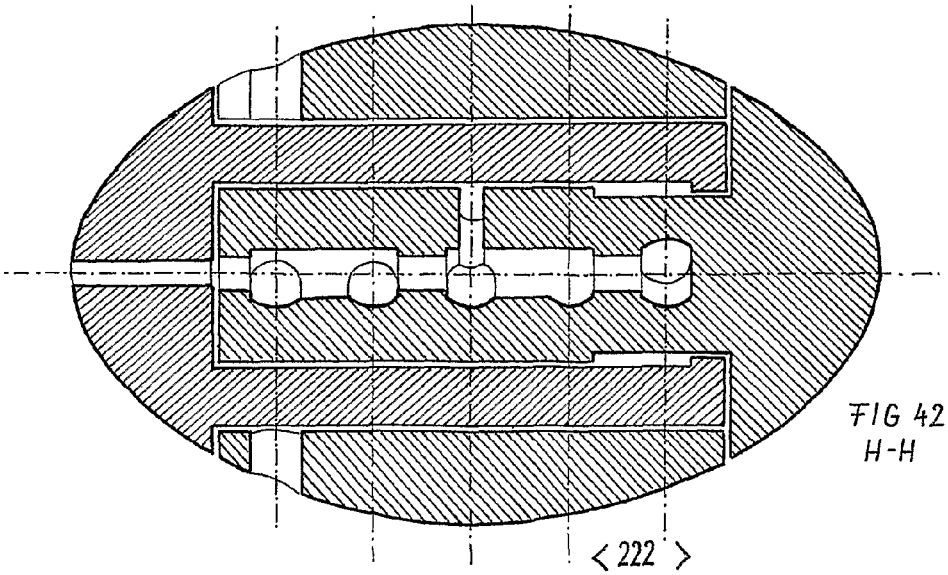
FIG. 42 is a sectional view of the spatial labyrinth game shown in FIG. 37, taken along plane H-H.
Figure 43:
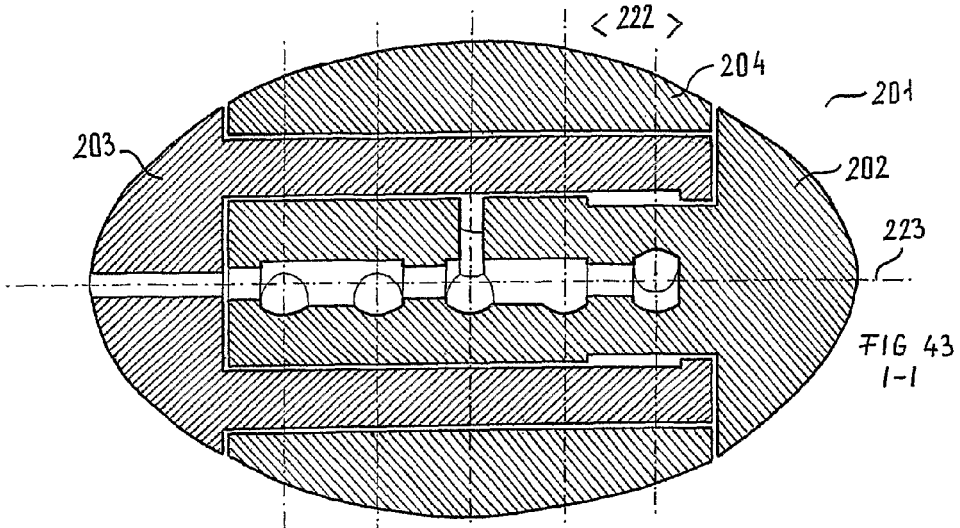
FIG. 43 is a sectional view of the spatial labyrinth game shown in FIG. 37, taken along plane I-I.
Figure 44:
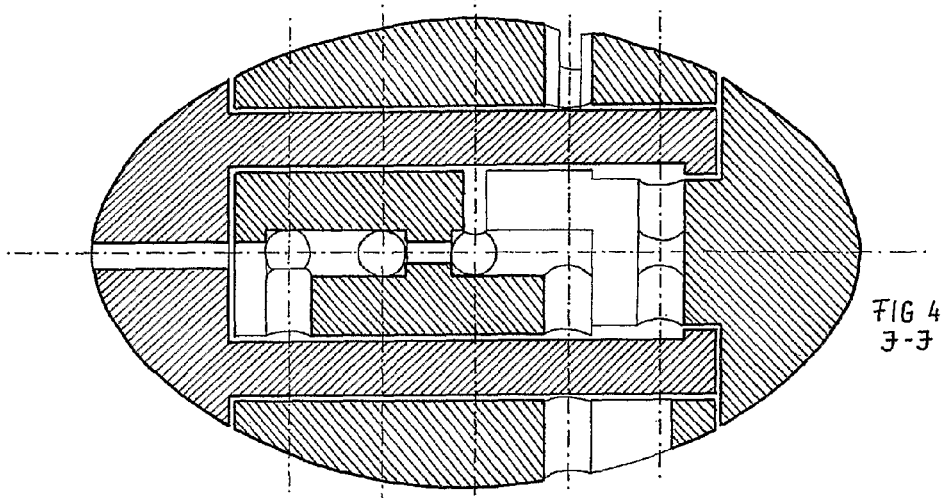
FIG. 44 is a sectional view of the spatial labyrinth game shown in FIG. 37, taken along plane J-J.
Figure 45:
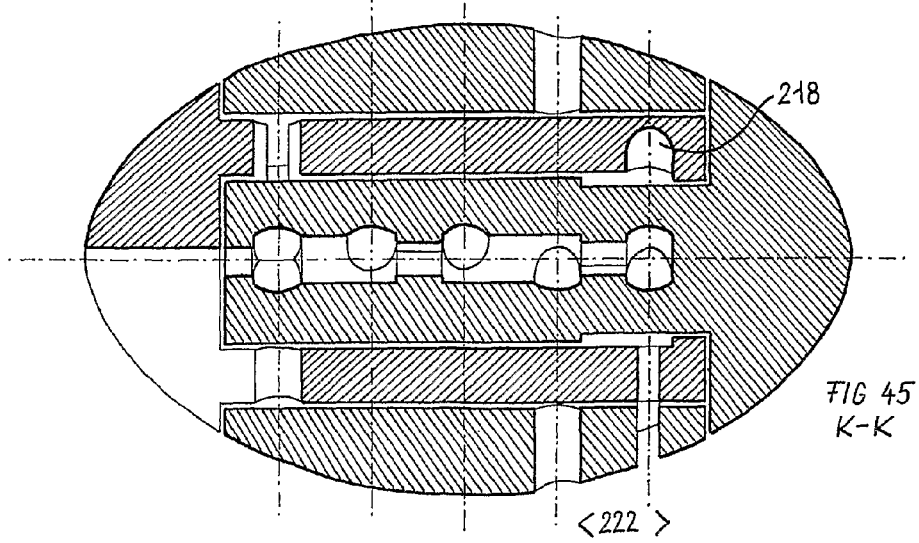
FIG. 45 is a sectional view of the spatial labyrinth game shown in FIG. 37, taken along plane K-K.
Figure 47F:
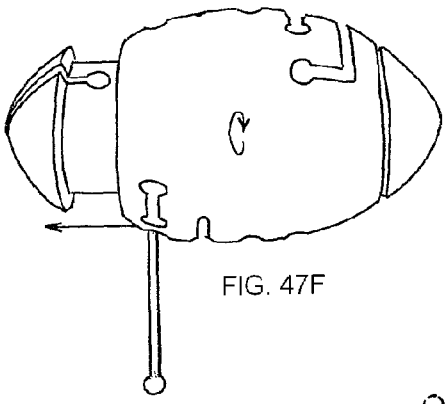
FIGS. 47A to 47T show the steps of the spatial labyrinth game of FIG. 26 through which the stick is moved.
Figure 47G:
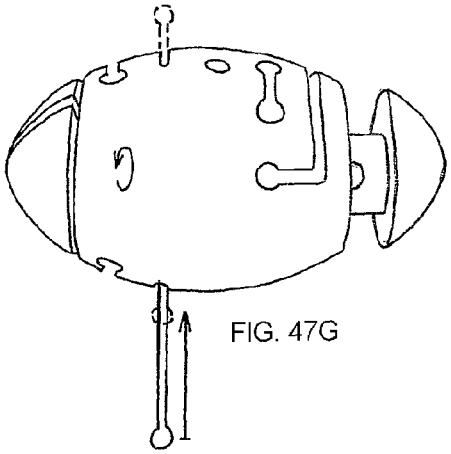
Figure 47H:
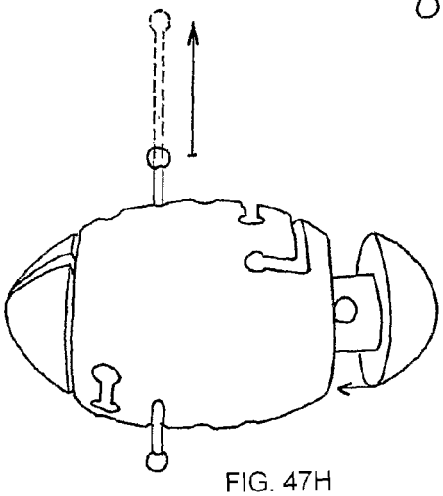
Figure 47I:
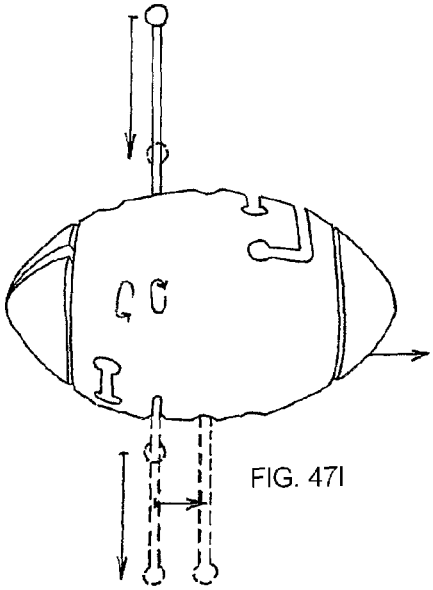
Figure 47J:
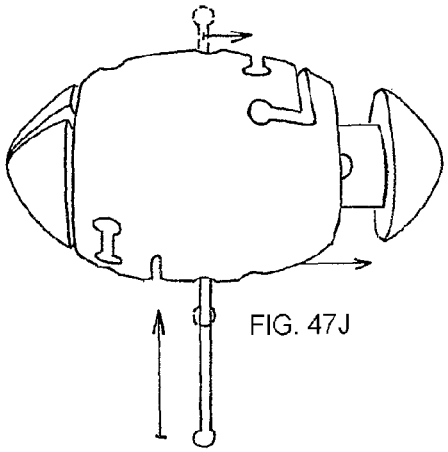
Figure 47K:
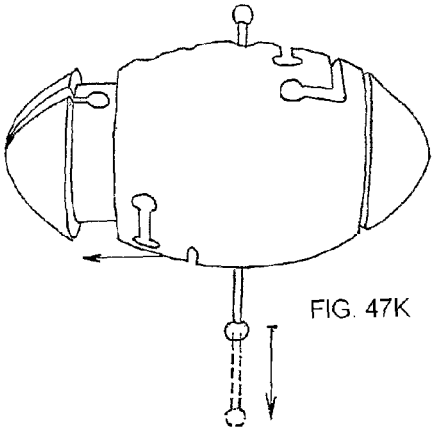
Figure 47L:
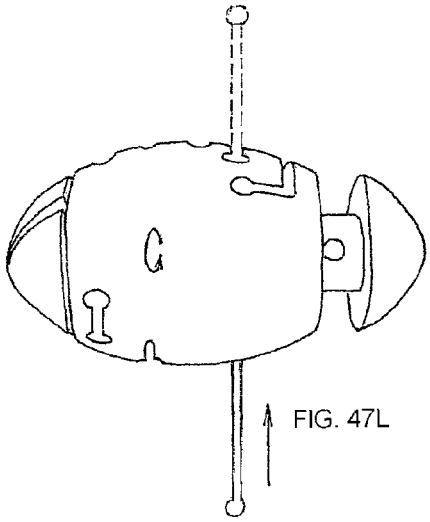
Figure 47M:
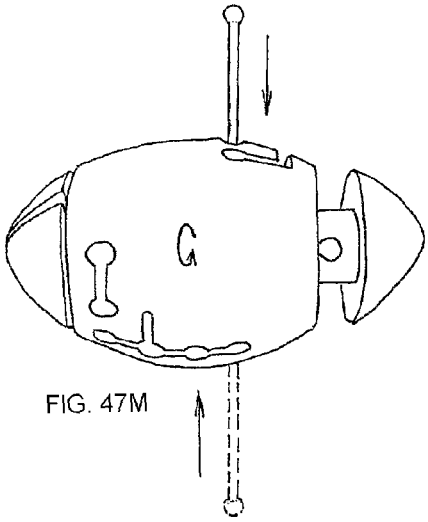
Figure 47N:
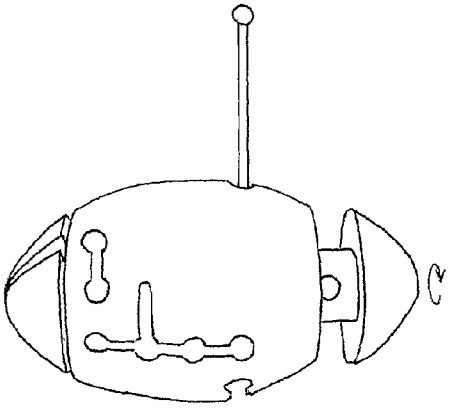
Figure 47O:
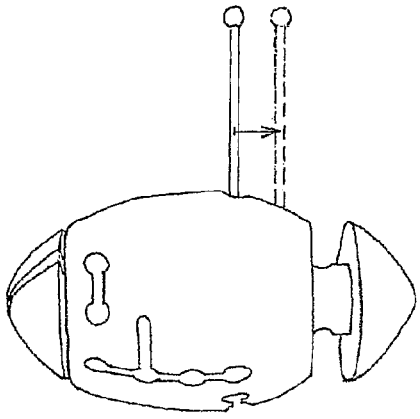
Figure 47P:
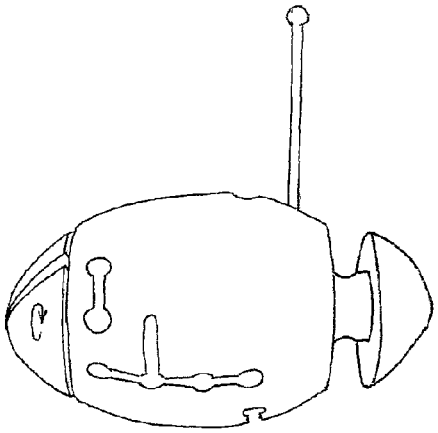
Figure 47Q:
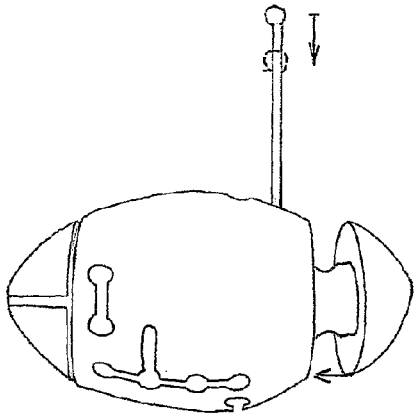
Figure 47R:
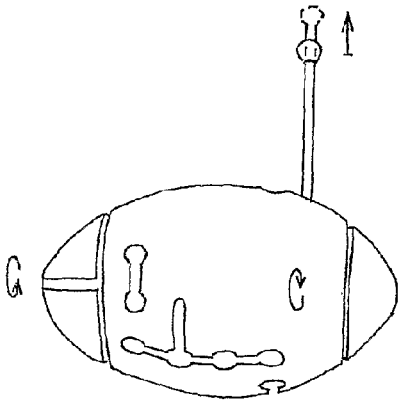
Figure 47S:
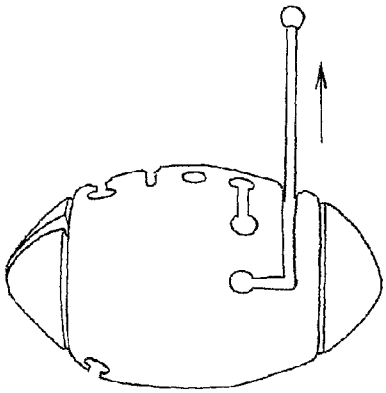
Figure 47T:
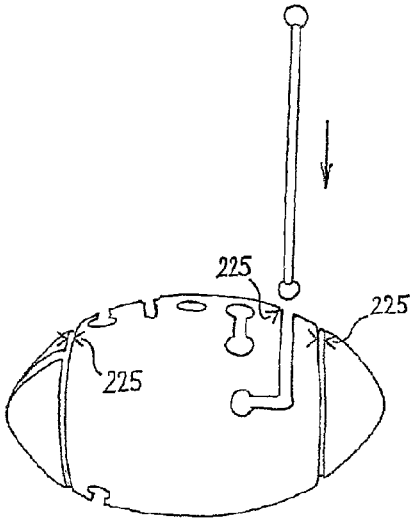

The body portion 202 has axially extending path sections 209, 210 and circumferential path sections 211, while the path section 216 of body portion 203 has an end 212, and along path section 214 there are broadening portions 213 dimensioned to correspond to the size of the head of the stick. The wall of the body portions 203, 204 comprises a pocket 217 visible from outside, and also comprises concealed pockets 218 as shown in FIGS. 39 and 45.

FIGS. 31-34 show different views of the spatial labyrinth game of FIG. 26 with the stick 7 inserted.

Figure 31:
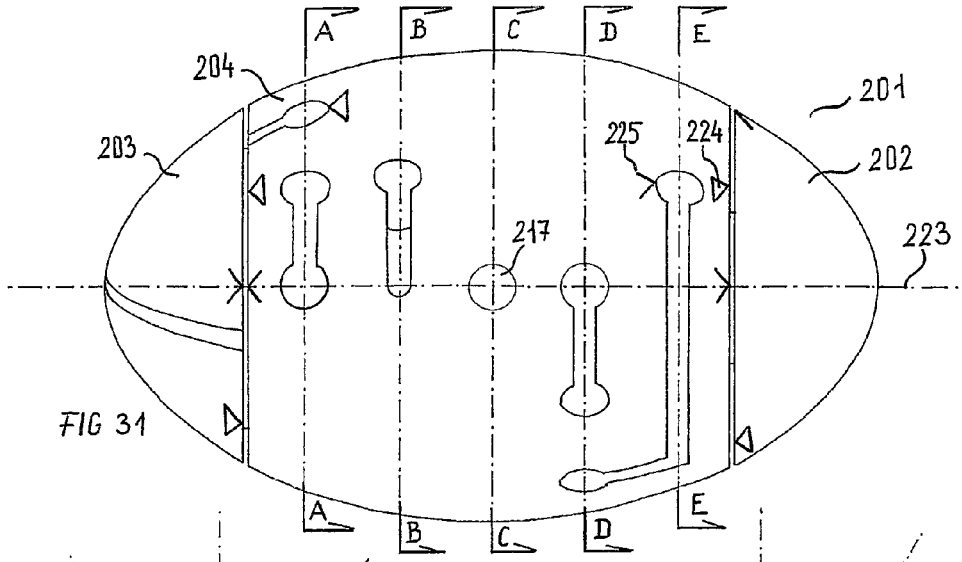
FIG. 31 is the front side elevation view of the spatial labyrinth game of FIG. 26.
Figure 32:
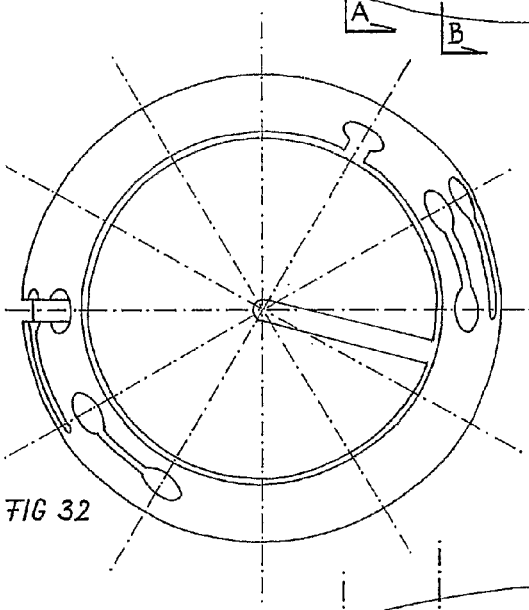
FIG. 32 is the front elevation view of the spatial labyrinth game of FIG. 26.
Figure 33:
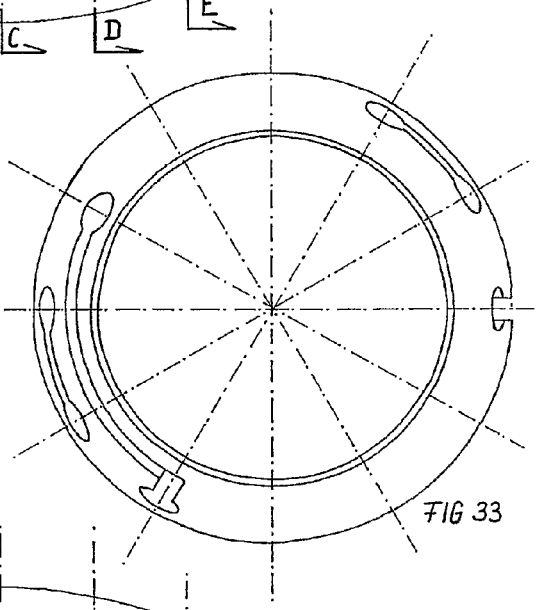
FIG. 33 shows the back elevation view of the spatial labyrinth game of FIG. 26.
Figure 34:
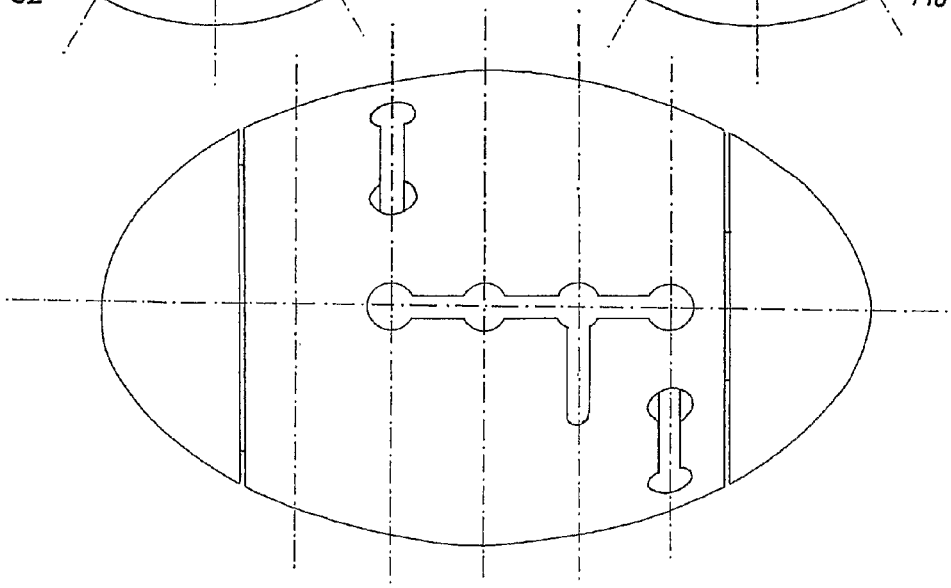
FIG. 34 shows the back side elevation view of the labyrinth game of FIG. 26.
Figure 35:
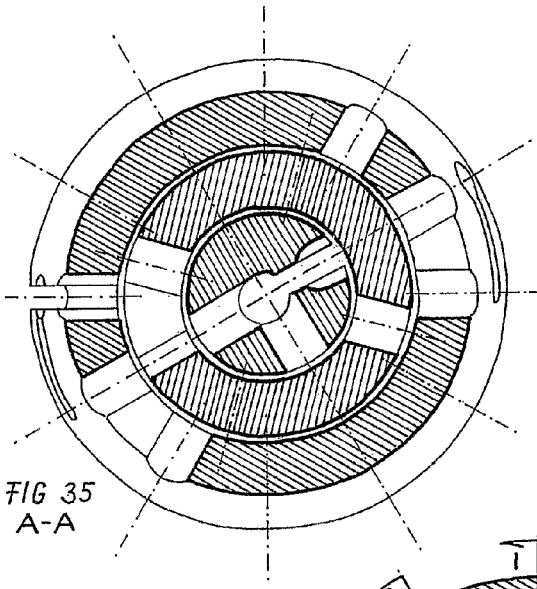
FIG. 35 shows the section of the labyrinth game of FIG. 31 taken along plane A-A.
Figure 36:
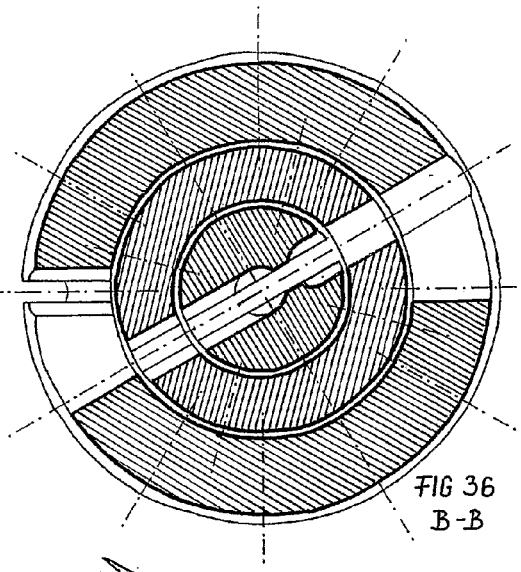
FIG. 36 is a sectional view of the spatial labyrinth game shown in FIG. 31, taken along plane B-B.

FIG. 31 and FIG. 34 illustrate the game showing side elevation views, and FIGS. 32-33 show front and back elevation views of the game.

FIGS. 31-34 shows the path sections and pockets disposed in the external body portion 204, as well as those portions of the path sections that are broadened to correspond to the size of the head portion of the stick.

FIGS. 35-39, respectively, show cross sectional views taken along planes A-A, B-B, C-C, D-D, and E-E of FIG. 31. The mutual arrangement of the three body portions and the shape, arrangement, and relative position of the path sections formed in the body portions are shown in these drawings.

Figure 37:
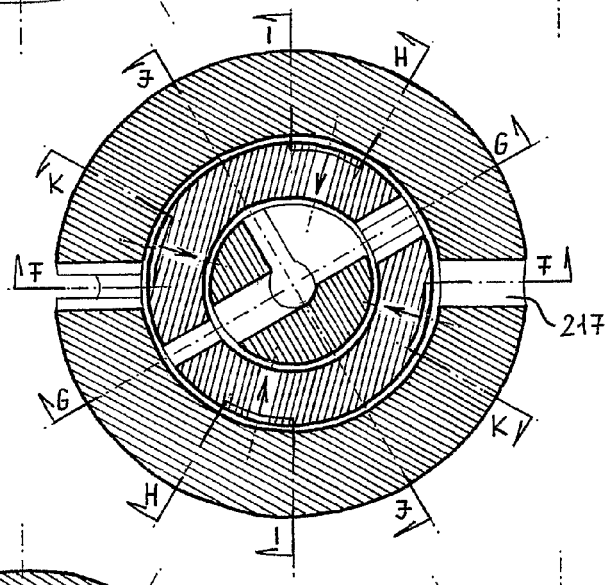
FIG. 37 is a sectional view of the spatial labyrinth game shown in FIG. 31, taken along plane C-C.
Figure 38:
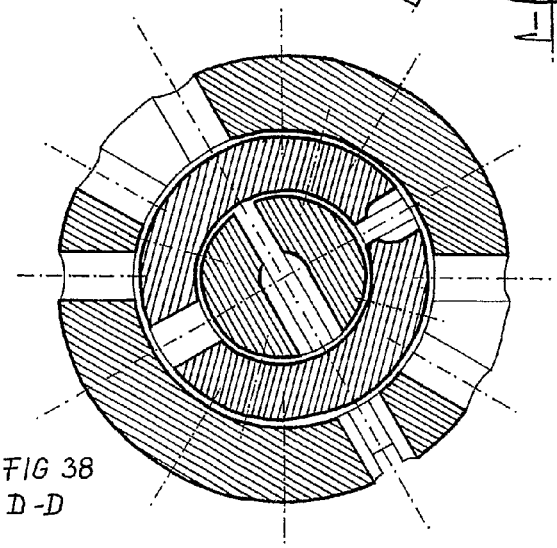
FIG. 38 is a sectional view of the spatial labyrinth game shown in FIG. 31, taken along plane D-D.

FIG. 40-45, respectively, show longitudinal sectional views taken along planes F-F, G-G, H-H, I-I, J-J, and K-K of FIG. 37. These drawings also illustrate the axial arrangement of the body portions, as well as the arrangement and relative axial position of the path sections disposed in them.

Conceivable steps of the game of moving the stick 7 through the labyrinth path formed in the body of the spatial labyrinth game according to FIG. 26 are described in detail below referring to FIG. 47.

To start the game, first the markings 224 on the body portions 202, 203, 204 should be aligned by rotating the portions relative to each other. After the alignment is made, the stick 7 is inserted perpendicularly to the axis 223 at the starting point 224 indicated by the marking 224, and is rotated to an position coinciding with the axis 223 (*a*). Then the body portion 202 is rotated clockwise, and the stick 7 is turned again into an upright position perpendicular to the axis 223 (*b*), and is pushed towards the axis 223 to the other side of body portion 204. The body portion 204 is then rotated in an anticlockwise direction (c) and the stick 7 is pushed back therein. Now the body portion 204 is rotated in an anticlockwise direction (d), the stick 7 is pushed through it, and the body portion 203 is first rotated clockwise and then pulled outwards (e). Thereafter the body portion 204 is pulled in the direction of the body portion 203, and rotated in a clockwise direction (f). The stick 7 is pushed in a direction perpendicular to the axis 223 to an extent that both head portions 9 extend from the body. Then the body portion 204 is rotated anticlockwise (g), the stick is pushed further until it stops, and the body portion 202 is pushed back (h). Subsequently the stick 7 is pushed towards of the axis 233 to such an extent that both head portions 9 are outside the body 201. The body portion 204 is now rotated clockwise, the stick 7 is pushed further, and the body portion 204 is rotated backwards, followed by pulling the body portion 202 outwards together with stick 7 (*i*). The stick 7 is pushed on such that the head portion 9 residing in the comes out of the body, and then the body portion 204 is displaced in an axial direction together with the stick 7 (*j*). The head portion 9 of the stick is pulled back into the body, and the body portion 204 is pushed back (k). The stick 7 is then pushed through the body, the body portion 204 is rotated in an anticlockwise direction (l), and the stick 7 is pushed back. The body portion 204 is rotated again in an anticlockwise direction, and the stick 7 is again pushed to the other side (m), and the body portion 202 is rotated in a clockwise direction (n) followed by pushing the body portion 204 parallel with the axis 223 towards the body portion 202. Thereafter the body portion 203 is rotated clockwise (p) until the head portion 9 of the stick 7 becomes insertable into the concealed pocket 215 disposed in the body portion 203. Subsequently the body portion is pulled back in place (q), and the body portion 204 is rotated clockwise, and the head portion 9 of the stick 7 is pulled out from the pocket. Thereby it becomes possible to rotate the body portion 203 in a clockwise direction (r) to such an extent that the stick 7 can be removed from the body 201 (*s*).

Similarly to the previous embodiment, the game can be played "backwards", starting from the point indicated by marking 225 that aids the initial alignment of the body portions.

The above description relates to the preferred embodiments of the spatial labyrinth game according to the invention and applications thereof. It should be borne in mind that the invention may be implemented in countless other ways.

For instance, the body of the game may be a multi-layer body constituted by principally concentrically arranged cylindrical portions with path sections, pockets, and ends disposed in their walls. Pockets may be visible from outside or concealed inside the body.

The path sections may be arranged in many different ways. In the embodiments presented above the path sections extend in axial, radial, and circumferential directions, but in a conceivable embodiment the path sections extend along spatial curves. Although in the two dynamic embodiments presented above the stick does not leave the internal body portions, embodiments where the stick leaves the internal portions and moves only through the external one may be conceived. The game may consist of interchangeable body portions, which provides the possibility for new combinations. The complexity of the game is limited by the structural thickness of the portions and by playability. The external portion may have an arbitrary shape. In case of the above described embodiments the external body portion is a single piece, but it may consist of multiple pieces that may be displaced relative to one another in an axial direction, and may also be rotated about their principal axis. Thereby the number of possible combinations may be further increased.

The presented embodiments of the game according to the invention apply a simple stick element but the arrangement of the labyrinth path allows the application of sticks having different configurations. For instance, instead of the straight stick with two identical head portions may be a stick with an additional element, having a size identical to or different from the size of the head portions, is disposed in the stem section between the two (optionally differently configured) heads may also be applied. The configuration of the head portion of the stick is dependent on the wall thickness of the body portions of the game. In addition to straight sticks having two heads, multiple-branch sticks may also be applied.

The labyrinth path should of course be arranged such that it corresponds to the type and geometry of the stick.

Advantages of the spatial labyrinth game according to the invention include the improvement of logical skill, spatial vision, dexterity, and memory. Since very easy and very difficult games may equally be produced, the game according to the invention may be of enjoyment to users at every age and at every stage of cognitive development.

Contemplating the labyrinth as a logical concept, and the basic shapes, structures, and materials applicable to it, the invention may be applied to make any kind of game different from the described embodiments.

A single game body may have several connected or independent paths of different difficulty.

The degree to which the body portions can be displaced in an axial direction affects the outside visibility of the internal portions.

The game may be implemented such that it can be to be taken to pieces, and may have a different number of body portions. In case the body portions of the game are arranged to be logically and geometrically interchangeable, the game becomes freely variable.

The game may also be implemented such that the toy element—the stick—to be moved through the labyrinth path remains inside the body during the entire game, and cannot be removed therefrom.

It has to be noted that the coherence of the enveloping shape of the body cannot be considered a basic requirement for arranging the body portions of the game.

LIST OF REFERENCE NUMERALS

1 body
2 path section
3 path section
4 path section
5 path section
6 end
7 stick
stem
9 head
10 path section
11 path section
12 path section
13 path section
14 arrow
15 arrow
16 starting point
17 arrow
18 arrow
19 arrow
20 arrow
21 arrow
22 arrow
23 arrow
24 arrow
25 arrow
26 arrow
27 arrow
28 arrow
29 arrow
30 axis
101 body
102 body portion
103 body portion
104 cylindrical portion
105 cylindrical portion
106 terminal portion
107 path section
108 portion
109 path section
110 path section
111 path section
112 end
113 path section
114 path section
115 path section
116 marking
117 pocket
118 axis
119 pullout length
201 body
202 body portion
203 body portion
204 body portion
205 cylindrical portion
206 terminal portion
207 cylindrical portion
208 terminal portion
209 path section
210 path section
211 path section
212 end
213 subsection
214 path section
215 path section
216 path section
217 visible pocket
218 concealed pocket
219 path section
220 path section
221 path end
222 pullout length
223 axis
224 marking
225 marking

The invention claimed is:

1. A spatial logical and skill improvement game, said game comprising an enveloping body containing a static or dynamic spatial labyrinth and a toy element adapted to be moved through the labyrinth, wherein the toy element is a stick, with a head portion being disposed at each end of a stem of the stick, where the labyrinth is adapted to conform to the spatial geometrical configuration of the head portions and the stem of the stick and to allow the motion of the stick, with spatial path sections being disposed in the body or in body portions, the path sections forming a labyrinth path and being arranged to allow the stick to be moved through them in a step-by-step manner, where the stick may be rotated in directions parallel with or perpendicular to the axis of the body, in directions perpendicular to or parallel with its own axis, freely rotated by combining the previous rotations, or moved along a spatial curve as it passes through the labyrinth, and where the body portions are movable relative to one another while the stick is moved through them, with the labyrinth allowing the motion of the stick being created by moving the body portions in a step-by-step manner, where the length of the stem of the stick should at least equal the transverse dimension of the body, and at least one of the heads is located outside the body as the stick is moved, with the labyrinth being arranged in the body such that the stick may be inserted and removed at respective specific locations, and the stick being prevented from getting removed from the body at any intermediate point of the path by either of its heads.

2. The spatial logical game according to claim 1, wherein the enveloping body is uniaxial and arranged in a single-layer or multiple-layer manner, with the layers of the body being freely rotatable relative to one another when the stick is not inserted in the body, or consists of body portions arranged to be axially displaceable to a predetermined extent, where the labyrinth is formed inside the body or the body portions by path sections, ends, sections, and pockets, and where the path sections are shaped to correspond to the geometry of the stem of the stick and the path ends, sections, and pockets are shaped to correspond to the shape of the head portions of the stick, such that the advancing motion of the stem of the stick is allowed by the path sections, the necessary pushing of the stick from one side of the body to the other is allowed by the ends and sections, and the necessary displacement of the body portions relative to one another is allowed by the head of the stick when it is inserted in the pockets.

3. The spatial logical game according to claim 1, wherein the body thereof is a single symmetric body of revolution, with path sections constituting the labyrinth and ends being arranged in the body, and the stick adapted to be moved through the labyrinth comprising a straight cylindrical stem and a spherical head at each end of the stem, where the stick is capable of being rotated in different spatial directions, is capable of being repeatedly pushed from one side of the body to the other, and is capable of being moved alternately forward and rearward relative to the axis of the body as it is moved through the labyrinth.

4. The spatial logical game according to claim 1, wherein the body thereof consists of two portions, an internal body portion shaped as a symmetric body of revolution, and an external body portion, where the internal and external body portions are freely rotatable and axially displaceable by a specific extent relative to each other, and where the elements constituting the labyrinth—path sections, ends, and pockets—are disposed in both the internal and the external body portions such that a stick having a straight stem and a spherical head at each end of the stem may be moved along the labyrinth path.

5. The spatial logical game according to claim 4, wherein the internal body portion thereof is formed by two different-diameter cylindrical portions and a terminal portion being connected to the smaller-diameter cylindrical portion at the end thereof opposite the larger-diameter cylindrical portion, and the external body portion thereof comprises different-diameter bores having a diameter corresponding to the diameter of the cylindrical portions of the internal body portion, where the pullout length of the internal body portion is determined by the different axial dimensions of the bores of the cylindrical portions and the external body portion, and where the cylindrical portions of the internal body portion are inserted in the bores of the external body portion such that the two body portions constitute an interconnected system.

6. The spatial logical game according to claim 5, wherein the outer surface of the terminal portion is shaped to correspond to the shape of the external body portion, where the terminal portion is adapted to facilitate the grabbing and displacing the internal body portion.

7. The spatial logical game according to claim 4, wherein path sections, adjoining and independent broadening ends and sections, as well as pockets are arranged in both the internal body portion and the external body portion thereof, where the pockets are outwardly concealed and may only be felt utilizing the moving stick during the game.

8. The spatial logical game according to claim 4, wherein the path sections, sections, and pockets disposed in the body portions constitute logical sections, with the external body portion also comprising intersecting path sections through which intersections the stick passes multiple times as it is moved along its path, where the stick may be rotated in different spatial directions, may be repeatedly pushed from one side of the body to the other also in a direction non-perpendicular to the axis of the body, and may be moved alternately forward and rearward relative to the axis of the body as it is moved through the labyrinth inside the body, with the body portions being axially and radially displaceable to the necessary extent as the stick moves through the labyrinth.

9. The spatial logical game according to claim 1, wherein the body consists of three body portions.

10. The spatial logical game according to claim 9, wherein the body consists of three coaxially arranged body portions that are freely rotatable relative to one another and are axially displaceable with respect to one another to a predetermined extent, with the toy element being implemented as a stick having a straight stem comprising a spherical head at each of its ends.

11. The spatial logical game according to claim 9, wherein the body thereof consists of an internal body portion consisting of a cylindrical portion made up of two different-diameter portions and a terminal portion connected to the smaller-diameter portion, a middle body portion consisting of two cylindrical portions having different-diameter bores and a terminal portion connected to the larger-bore cylindrical portion at the side opposite the smaller-bore portion, and an external body portion shaped as a symmetric body of revolution having a bore dimensioned to correspond to the external diameter of the cylindrical portion of the middle body portion, where the axial dimension of the external body portion corresponds to axial dimension of the cylindrical portions of the internal and middle body portions, with the external body portion being adapted to be pulled out in an axial direction relative to the internal and middle body portions to a pullout length corresponding to the allowed relative displacement of the internal and middle body portions, with the diameter of the cylindrical bores of the middle body portion being chosen to correspond to the diameter of the diameter of the different-diameter portions of the internal body portion, where the internal body portion is received in the bores of the middle body portion and the external body portion is placed on the cylindrical portion of the middle body portion such that the internal, middle, and external body portions constitute an interconnected functioning system.

12. The spatial logical game according to claim 10, wherein the outer surface of the terminal portions adapted for allowing the grabbing and displacing the internal and middle body portions is shaped to correspond to the outer shape of the external body portion.

13. The spatial logical game according to claim 10, wherein path sections composed of spatial logical sections are disposed in the body portions of the body, with the body also comprising ends adjoining to and independent from the path sections, as well as pockets, where the stick is capable of being rotated in different spatial directions, may be repeatedly pushed from one side of the body to the other as it is moved through the labyrinth inside the body, with the body portions being axially and radially displaceable to the necessary extent as the stick moves through the labyrinth.

14. The spatial logical game according to claim 1, wherein it has path sections extending along spatial curves.

15. The spatial logical game according to claim 1, wherein the toy element is branched, or has a curved stem.

16. The spatial logical game according to claim 1, wherein the enveloping body has a regular shape.

17. The spatial logical game according to claim 1, wherein the enveloping body and the toy element thereof are made from a solid material.

18. The spatial logical game according to claim 1, where the labyrinth of the body has a logical arrangement that comprises outwardly concealed pockets, intersecting path sections, and impasses that make it more difficult to move the stick through the labyrinth.

19. The spatial logical game according to claim 1, wherein the enveloping body has an ovoid shape.

20. The spatial logical game according to claim 1, wherein the enveloping body consists of body portions, which body portions consist of multiple subportions.

* * * * *